US012760600B2

(12) United States Patent
Marson et al.

(10) Patent No.: US 12,760,600 B2
(45) Date of Patent: Oct. 13, 2026

(54) ROTARY STEERABLE SYSTEM WITH ACTIVE PAD PROPORTIONAL CONTROL

(71) Applicant: TAQA DRILLING SOLUTIONS INC., Edmonton (CA)

(72) Inventors: Daniel A. Marson, Edmonton (CA); Geoffrey A. Samuel, Edmonton (CA); Kyle J. Sears, Edmonton (CA); Jonathan Zacharko, Edmonton (CA); Daniel Sullivan, Cheltenham (GB); Crowley Daniel Brendan, Churchdown (GB); Jonathan Shim, Edmonton (CA)

(73) Assignee: TAQA DRILLING SOLUTIONS INC., Edmonton (CA)

( * ) Notice: Subject to any disclaimer, the term of this patent is extended or adjusted under 35 U.S.C. 154(b) by 0 days.

(21) Appl. No.: 18/993,568

(22) PCT Filed: Jul. 27, 2023

(86) PCT No.: PCT/CA2023/000017
§ 371 (c)(1),
(2) Date: Jan. 12, 2025

(87) PCT Pub. No.: WO2024/020665
PCT Pub. Date: Feb. 1, 2024

(65) Prior Publication Data

US 2026/0028881 A1 Jan. 29, 2026

Related U.S. Application Data

(60) Provisional application No. 63/392,736, filed on Jul. 27, 2022.

(51) Int. Cl.
*E21B 7/06* (2006.01)
*E21B 34/14* (2006.01)

(52) U.S. Cl.
CPC ..... *E21B 7/06* (2013.01); *E21B 34/14* (2013.01); *E21B 2200/06* (2020.05)

(58) Field of Classification Search
CPC ..... E21B 7/06; E21B 34/14; E21B 2200/06
See application file for complete search history.

(56) References Cited

U.S. PATENT DOCUMENTS 5,265,682 A 11/1993 Russell et al.
9,624,727 B1 4/2017 Hutton
(Continued)

FOREIGN PATENT DOCUMENTS

WO 2019009911 A1 1/2019
WO 2019160559 A1 8/2019
(Continued)

OTHER PUBLICATIONS

International Search Report re PCT/CA2023/000017, completed by the ISA/CA on Oct. 10, 2023, and mailed by the ISA/CA on Oct. 25, 2023.
(Continued)

*Primary Examiner* — Steven A Macdonald
(74) *Attorney, Agent, or Firm* — Donald V. Tomkins

(57) ABSTRACT

A push-the-bit steering tool for drilling deviated wellbores comprises a steering head mountable to the bottom of a drill string and having steering pads extendable and retractable by fluid-actuated pistons; a fluid manifold co-rotatingly mounted to the steering head for delivering fluid to the pistons; a rotationally geostationary primary valve for delivering fluid to the fluid manifold; and a secondary valve for delivering fluid to the primary valve. The primary valve has a flow restrictor for regulating fluid flow to the pistons such that the steering pads will be sequentially actuated as the drill string rotates, and the steering force exerted against the wellbore by each sequentially-actuated steering pad will be
(Continued)

in a constant selected direction. All of the pistons are hydraulically connected, thereby enabling dependent control of steering pad extension and dependent and positive control of steering pad retraction.

12 Claims, 15 Drawing Sheets

(56) References Cited

U.S. PATENT DOCUMENTS

| | | | | |
|---|---|---|---|---|
| 9,869,140 | B2 * | 1/2018 | Rushton | E21B 17/1014 |
| 10,287,821 | B2 | 5/2019 | Marson et al. | |
| 10,364,608 | B2 | 7/2019 | Lines et al. | |
| 10,415,363 | B2 | 9/2019 | Mauldin et al. | |
| 10,641,077 | B2 | 5/2020 | Sullivan et al. | |
| 10,655,447 | B2 | 5/2020 | Tilley et al. | |
| 11,187,042 | B2 * | 11/2021 | Doud | E21B 7/06 |
| 11,365,586 | B2 | 6/2022 | Chambers et al. | |
| 11,371,288 | B2 | 6/2022 | D'Silva et al. | |
| 12,467,327 | B1 * | 11/2025 | Richards | E21B 21/10 |
| 2002/0011358 | A1 * | 1/2002 | Wassell | E21B 7/06 175/73 |
| 2003/0051919 | A1 * | 3/2003 | Moore | E21B 7/062 175/73 |
| 2006/0090935 | A1 * | 5/2006 | Van Steenwyk | E21B 7/068 175/73 |
| 2014/0262507 | A1 | 9/2014 | Marson et al. | |
| 2018/0094490 | A1 | 4/2018 | Lines et al. | |
| 2018/0094516 | A1 | 4/2018 | Mauldin et al. | |
| 2018/0258702 | A1 | 9/2018 | Marson et al. | |
| 2018/0298743 | A1 | 10/2018 | Sullivan et al. | |
| 2019/0301244 | A1 * | 10/2019 | Moore | E21B 47/024 |
| 2019/0352558 | A1 | 11/2019 | Tilley et al. | |
| 2020/0032587 | A1 | 1/2020 | Lines et al. | |
| 2020/0063497 | A1 | 2/2020 | Hutton | |
| 2020/0072033 | A1 | 3/2020 | Mauldin et al. | |
| 2020/0325731 | A1 * | 10/2020 | Chambers | E21B 7/068 |
| 2020/0392790 | A1 * | 12/2020 | Perry | E21B 10/327 |
| 2021/0087885 | A1 * | 3/2021 | Chambers | E21B 7/061 |
| 2021/0285290 | A1 * | 9/2021 | D'Silva | E21B 7/062 |

FOREIGN PATENT DOCUMENTS

| | | | |
|---|---|---|---|
| WO | 2019160562 | A1 | 8/2019 |
| WO | 2020210905 | A1 | 10/2020 |

OTHER PUBLICATIONS

Written Opinion of the International Searching Authority re PCT/CA2023/000017, completed by the ISA/CA on Oct. 13, 2023, and mailed by the ISA/CA on Oct. 25, 2023.

* cited by examiner

220

ROTARY STEERABLE SYSTEM WITH ACTIVE PAD PROPORTIONAL CONTROL

FIELD

The present disclosure relates in general to systems and apparatus for directional drilling of wellbores, particularly for oil and gas wells, and relates in particular to "push-the-bit" rotary steerable systems for directional drilling while the drill string is rotating.

BACKGROUND

In drilling a borehole (or wellbore) into the earth, such as for the recovery of hydrocarbons or minerals from a subsurface formation, it is conventional practice to connect a drill bit onto the lower end of a "drill string", and then rotate the drill string so that the drill bit progresses downward into the earth to create the desired borehole. A typical drill string is made up from an assembly of drill pipe sections connected end-to-end, plus a "bottomhole assembly" ("BHA") disposed between the bottom of the drill pipe sections and the drill bit. The BHA is typically made up of sub-components such as drill collars, stabilizers, reamers and/or other drilling tools and accessories, selected to suit the particular requirements of the wellbore being drilled.

In conventional vertical borehole drilling operations, the drill string and bit are rotated by means of either a "rotary table" or a "top drive" associated with a drilling rig erected at the ground surface over the borehole. During the drilling process, a drilling fluid (commonly referred to as "drilling mud" or simply "mud") is pumped under pressure downward from the surface through the drill string to the drill bit, then out the drill bit into the wellbore, and then upward back to the surface through the annular space ("wellbore annulus") between the drill string and the wellbore. The drilling fluid carries borehole cuttings to the surface, cools the drill bit, and forms a protective cake on the borehole wall (to stabilize and seal the borehole wall), as well as other beneficial functions.

As an alternative to rotation by a rotary table or a top drive, a drill bit can also be rotated using a "downhole motor" (also referred to as a "drilling motor" or "mud motor") incorporated into the BHA immediately above the drill bit. Downhole motors can be used to rotate the drill bit in conjunction with rotation of the drill string or (in so-called "slide" drilling operations) without rotation of the drill bit, as operational conditions may require.

Particularly since the mid-1980s, it has become increasingly common and desirable in the oil and gas industry to use "directional drilling" techniques to drill horizontal and other non-vertical wellbores, to facilitate more efficient access to and production from larger regions of subsurface hydrocarbon-bearing formations than would be possible using only vertical wellbores. In directional drilling, specialized downhole tools and systems—commonly referred to as rotary steerable systems (or RSS)—are used to induce, monitor, and control deviations in the path of the drill bit as it progresses into the earth, to produce a wellbore of desired non-vertical configuration.

Rotary steerable systems (RSS) currently used in drilling oil and gas wells into subsurface formations commonly incorporate tools that operate above the drill bit as independent tools controlled from the surface. These tools are used to steer the drill bit in a desired direction away the local axis of the wellbore in order to form a wellbore (or a portion of the wellbore) that has a horizontal or other non-vertical orientation (commonly referred to as a "deviated wellbore").

There are two main categories of rotary steerable drilling systems commonly used for directional drilling. In "point-the-bit" drilling systems, the orientation of the drill bit is varied relative to the centerline of the drill string to achieve a desired wellbore deviation. In "push-the-bit" systems, an effectively constant lateral force is applied, in a selected transverse direction, to the BHA of the drill string carrying the drill bit, thereby causing radial deflection or displacement of the drill bit away from the local axis of the wellbore and causing the bit to drill the wellbore in a desired deviated path. This functionality is provided by a steering section (or "steering head") incorporated into the BHA immediately about the drill bit.

The steering head typically incorporates two or more steering members (alternatively referred to as steering pads) arrayed at equal circumferential intervals. Each steering member has a contact surface that is contoured for contacting engagement with the generally cylindrical wall of the wellbore being drilled. These steering members can be selectively extended or deflected radially outward from the rotating steering head (typically by means of hydraulic pressure provided by drilling fluid flowing downward through the drill string to the drill bit) to exert laterally compressive forces against the wellbore wall.

The steering members are sequentially extended outward from the steering head as the drill string rotates. The steering member that happens to be pushing against the wellbore at a given point in time (over a predefined angular segment or arc length of the wellbore surface) may be referred to for purposes of the present disclosure as the "operative steering member" (or "operative pad"). As the operative steering member comes out of contact with the wellbore due to rotation of the drill string (and thus ceases to be the operative steering member), the next circumferentially-adjacent steering member will become the operative steering member and will be extended to push against the wellbore in the same direction, and so on. Accordingly, the radial displacement of the drill bit relative to the local wellbore axis will always be in the selected direction (for a given operational setting of the RSS), and the lateral force exerted against the wellbore wall by the steering members will always be in the same direction, despite the rotation of the drill string.

This functionality is achieved by diverting a portion of the downward flow of drilling fluid, by means of a suitable fluid manifold and valve arrangement, to actuate the operative steering member, with the portion of the fluid flow actuating the operative steering member typically being exhausted from the steering head into the wellbore annulus. Control and regulation of fluid flow diversion through the steering head to actuate the steering members (including fluid pressure regulation and, in turn, the magnitude of the force applied by the steering members to the wellbore), and selective control of the radial direction of the lateral force applied by the steering members to the wellbore (relative to the longitudinal axis of the steering head, the spatial orientation of which will change as directional drilling operations progress), are controlled by an instrumentation package forming the uppermost section of the complete RSS assembly.

In some "push-the-bit" RSS tools, the steering members may be provided on the outer ends of pistons that can be extended radially outward from the tool. In other "push-the-bit" tools, the steering members may be provided as clamshell-like pads, each of which is pivotable along one longitudinal edge about a pivot axis offset from and parallel to the longitudinal axis of the steering head, and which therefore can be pivotingly deflected into compressive contact with the wellbore by means of extendable pistons housed in the steering head.

Regardless of the configuration of the steering members, conventional "push-the-bit" tools typically provide for independent steering member extension control, by independently controlling the pressurized flow of drilling fluid to each extendable piston (i.e., such that a given extendable piston will be subjected to actuating fluid pressure only when its associated steering member is the "operative" steering member). During intervals when no fluid pressure is acting on a given piston, that piston will be essentially free-floating within its piston chamber, and will tend to be urged back to its retracted position only passively due to incidental contact of the associated steering member with regions of the wellbore wall away from the piston contact zone on the wellbore, as the drill string continues to rotate. However, the passive steering members do not always retract completely, and lateral force is undesirably consumed to retract them, thus impacting steering capacity and response time.

Another problem with conventional "push-the-bit" tools is that their steering rate (meaning the rate at which they deviate the path of the wellbore) is not directly controllable. If it is desired to reduce the steering rate in a given section of a wellbore (e.g., to increase the radius of a curved section of the wellbore), the common practice is to activate the tool's steering system intermittently. For example, if fluid flow to the steering system is alternated for 30 seconds "on" and 30 seconds "off", the net steering rate will be 50% of the steering rate for continuous fluid flow. This might be operationally effective to some degree, but it creates a series of curved and straight wellbore sections to approximate the intended larger-radius curvature, rather than a more desirable constant-radius curvature.

BRIEF SUMMARY

In general terms, the present disclosure teaches embodiments of a push-the-bit rotary steerable system (RSS) comprising:

- a steering section ("steering head");
- a hydraulics section (alternatively, "valve section") incorporating a rotationally geostationary primary (or "main") valve and a secondary valve that controls fluid flow to the primary valve;
- a fluid manifold disposed between the upper end of the steering section and the lower end of the primary valve, for directing the downward flow of pressurized drilling fluid from the primary valve either partially to piston banks in the steering head (as described in further detail below) and partially through the steering head to the drill bit, or entirely through the steering head to the drill bit, according to the operative position of the secondary valve; and
- an instrumentation section, for controlling the valve section and fluid flow to the steering section, and thus controlling the profile of the wellbore formed by the steering section.

The steering section, hydraulics section, and instrumentation section are sequentially and coaxially incorporated into the bottom hole assembly (BHA) of a drill string, with a drill bit mounted to the lower end of the steering section.

The instrumentation section controls the flow of drilling fluid through of the valve section, and is used to sense the orientation and direction of the RSS by means of inclination and/or azimuth sensors such as accelerometers and associated control hardware, and thereby to control the path or profile of a wellbore being drilled by the RSS, in accordance with known technologies in the field of directional drilling.

The present disclosure primarily relates to the steering section and the valve section of the RSS, individually and in combination.

Steering Section

In one non-limiting embodiment of an RSS tool in accordance with the present disclosure, the steering section comprises:

- an elongate and generally cylindrical steering head body (or simply "steering head") having a longitudinal axis and a steering head bore extending through its length, for conveying drilling fluid to a drill bit connected to the lower end of the steering head (either directly or through intermediate structure);
- two or more clamshell-type steering members (or "pads") arrayed at typically uniform angular spacing, with each steering member having a first longitudinal side edge that is pivotably mounted to an outer surface of the steering head about a pivot axis defined by a pivot pin radially offset from and at least substantially parallel to the longitudinal axis of the steering head;
- one or more banks of two or more steering member extension pistons (alternatively referred to herein as primary pistons), each having a primary piston axis and being reciprocatingly movable within an associated primary piston chamber formed in the steering head, such that each primary piston is outwardly extendable relative to the steering head, wherein:
  - the number of primary pistons in each primary piston bank corresponds to the number of steering members;
  - the primary pistons in each primary piston bank are circumferentially arrayed in a common transverse plane such that outward movement (i.e., extension) of a given primary piston from its associated primary piston chamber will urge pivoting outward movement of the associated steering member;
  - the orientation of the primary piston axes may be either radial or non-radial relative to the longitudinal axis of the steering head;
  - the primary piston axes of all primary pistons in each of the one or more banks of primary pistons preferably (but not necessarily) lie in a common plane transverse to the longitudinal axis of the steering head; and
  - in embodiments having multiple primary piston banks, the multiple primary piston banks are axially spaced;
- for each steering member, at least one steering member retraction tab (or "tailpiece") extending from the first longitudinal side edge of the steering member in a direction circumferentially away from the steering member, wherein: (1) the axial position of each tailpiece is axially offset from the axial position of any of the one or more banks of primary pistons; and (2) the axial positions of all the tailpieces relative to the steering head are preferably but not necessarily coincident; and
- one or more banks of steering member retraction pistons (alternatively referred to herein as secondary pistons), with each secondary piston having a secondary piston axis and being reciprocatingly movable within an associated secondary piston chamber formed in the steering head, wherein: (1) the number of secondary pistons in the secondary piston bank corresponds to the number of steering members; (2) the secondary pistons are circumferentially arrayed and longitudinally positioned such that outward movement (i.e., extension) of a given secondary piston from its associated secondary piston chamber will urge pivoting outward movement of the associated tailpiece (about the pivot axis of the associated steering member), thereby urging the associated steering member to pivot toward a retracted position against or adjacent to the steering head.

Hydraulics Section

As noted above, the hydraulics section ("valve section") incorporates a primary (or "main") valve and a secondary valve. The primary valve is configured to receive a flow of drilling fluid diverted from the main downward flow of drilling fluid through the drill string by the secondary valve, when the secondary valve is in an open position, and delivers the diverted fluid to a fluid manifold, which is co-rotatingly mounted to the upper end of the steering head. The fluid manifold defines primary and secondary manifold fluid passages extending between respective primary and secondary manifold inlet ports at the upper end of the fluid manifold and respective primary and secondary manifold outlet ports at the lower end of the fluid manifold, with each of the primary and secondary manifold outlet ports being in fluid communication with an associated primary or secondary fluid supply channel (as the case may be) in the steering head. As well, the fluid manifold defines one or more manifold fluid bypass channels providing a bypass flow path for the non-diverted portion of the drilling fluid to continue downward through the steering head bore to the drill bit.

The primary valve is controllable by the instrumentation section so as to remain rotationally geostationary, with the term "rotationally geostationary" meaning, for purposes of the present disclosure, that the primary valve does not rotate about its longitudinal axis relative to the earth despite rotation of other components of the drill string, including the primary valve housing. This functionality is provided in accordance with known technologies by means of a motor/actuator apparatus that rotates the primary valve about its longitudinal axis in the opposite rotational direction of the drill string but at the same rotational rate.

The primary valve is disposed directly above the upper end of the fluid manifold. In one exemplary embodiment, a lower portion of the primary valve defines a primary valve fluid chamber that is in fluid communication with the primary and secondary manifold fluid inlet ports at the upper end of the fluid manifold. Accordingly, diverted fluid discharged into the primary valve fluid chamber by the primary valve (when the secondary valve is in an open position) will flow into the primary and secondary manifold fluid inlet ports.

In one exemplary embodiment of an RSS in accordance with the present disclosure, the steering head has three steering members, meaning that the fluid manifold has three primary and three secondary manifold fluid passages and, therefore, three primary and three secondary manifold fluid inlet ports. These six manifold fluid inlet ports are arranged, in alternating fashion, in a circular pattern at the upper end of the manifold; e.g., with primary manifold fluid inlet ports at 12 o'clock, 4 o'clock, and 8 o'clock, and with secondary manifold fluid inlet ports at 2 o'clock, 6 o'clock, and 10 o'clock.

The lower end (i.e., the fluid discharge end) of the primary valve incorporates a flow restriction device (or "flow restrictor") configured such that, in this exemplary embodiment, fluid can be discharged into only three adjacent manifold inlet ports at any given time; e.g., the manifold inlet ports at 12 o'clock, 2 o'clock, and 4 o'clock, or the manifold inlet ports at 4 o'clock, 6 o'clock, and 10 o'clock, and so on. Accordingly, the particular group of three adjacent manifold inlet ports into which pressurized fluid can be delivered by the primary valve at any given time will change as the drill string rotates relative to the rotationally geostationary primary valve, such that pressurized fluid will flow to the primary piston chamber(s) associated with the operative steering member (at a given point in time), and to the secondary piston chamber(s) for the non-operative steering members to extend the associated secondary pistons to engage the associated steering member tailpieces and thus actively retract the non-operative steering members.

In an alternative embodiment (not illustrated herein), the upper end of the fluid manifold has only three manifold inlet ports, but each of these inlet ports branches off into a primary manifold fluid passage and a secondary manifold fluid passage which, like the primary and secondary manifold fluid passages of the embodiment described above, lead to associated primary and secondary manifold fluid outlet ports at the lower end of the fluid manifold, in fluid communication with associated primary or secondary fluid supply channels in the steering head. In this alternative embodiment, the flow restrictor of the primary valve may be configured such that fluid can be discharged into only one of the three manifold fluid inlet ports at any given time.

After a given steering member has temporarily ceased to be the operative steering member and is being actively retracted by actuation of the associated secondary piston(s), the fluid just previously used to extend that steering member into contact with the wellbore will be exhausted from the associated primary piston chamber(s) through an associated primary fluid exhaust channel formed in the steering head and exiting through a primary exhaust port proximal to the lower end of the steering head. As that steering member later becomes the operative steering member once again, the fluid just previously used to actively retract it may be exhausted from the associated secondary piston chamber(s) via a secondary exhaust nozzle axially proximal to the secondary piston chamber(s), or, alternatively, through an associated secondary fluid exhaust channel formed in the steering head and exiting through a secondary exhaust port proximal to the lower end of the steering head.

In contrast to prior art fluid-actuated rotary steerable systems that provide for independent control of steering member extension, RSS embodiments in accordance with the present disclosure provides for dependent control of steering member extension, as well as dependent and positive (or "active") control of steering member retraction, by having all of the primary and secondary pistons hydraulically connected within the same pressure system. Accordingly, the primary valve and the fluid manifold control the relationships between all of the primary and secondary pistons and, therefore, between all of the steering members.

The particular configurations of the primary and secondary manifold fluid passages between their respective manifold fluid inlets and manifold fluid outlets, as well as the particular arrangements of the manifold fluid inlets and manifold fluid outlets on the upper and lower ends, respectively, of the fluid manifold, will generally be a matter of engineering design choice to meet case-specific operational criteria. Fluid manifolds in accordance with the present disclosure may be fabricated using additive manufacturing processes (i.e., "3D printing").

As a given steering member (the "operative steering member" or "operative pad") is being outwardly deflected from the steering head by the extension of the operative steering member's one or more primary pistons, the non-operative steering members will concurrently be actively retracted by the extension of their secondary pistons applying outward force to the non-operative steering members' steering member retraction tabs (tailpieces), urging the non-operative steering members toward their retracted positions. This "active pad retraction" feature provides for quicker and more positive retraction (or "collapse") of the non-operative steering members, and thus helps to prevent unwanted contacts between non-operative steering members and the wellbore.

The secondary valve is controllable to activate or deactivate the RSS tool's hydraulic system, by initiating or shutting off the flow of diverted fluid to the primary valve. When the secondary valve is in the fully-open (or "ON") position, the RSS's hydraulic system operates normally to control steering member extension and retraction, with maximum fluid flow and pressure being delivered to the steering members. When the secondary valve is in the fully-closed (or "OFF") position, it shuts off fluid flow to the primary valve and the fluid manifold such that the steering members are not actively controlled for extension or retraction. This feature is beneficial in situations where it is desired for the steering members to be inactive while the RSS is still powered hydraulically (i.e., with continuing fluid flow to the drill bit), such as during "pulling-out-of-hole" operations (i.e., when the drill string is being withdrawn from the wellbore).

The secondary valve also facilitates and enables proportional control of the system by controlling the secondary valve's duty cycle (i.e., how much of the time the secondary valve is fully open, fully closed, or at an intermediate position between fully open and fully closed). This makes it possible to control steerability and steering rate by operating the secondary valve at a selected intermediate position between fully open and fully closed, thereby mechanically controlling the rate and pressure of fluid flow from the secondary valve into the main valve and the steering head. In this way, the secondary valve facilitates additional and more precise control of the RSS tool's operation.

In one embodiment of an RSS tool in accordance with the present disclosure, the secondary valve may be provided in the form of a solenoid valve (a term that will be understood by persons of ordinary skill in the art), disposed above the primary valve within the valve section.

In an alternative embodiment, the secondary valve may be provided in the form of a sleeve valve comprising a generally cylindrical sleeve that is axially movable within a valve section annulus between the primary valve and the tool housing, between:

a closed position in which the sleeve prevents diversion of fluid from the valve section annulus into the primary valve; and a fully-open position allowing maximum fluid flow from the valve section annulus into the primary valve (and into the fluid passages in the fluid manifold).

The sleeve valve can also be selectively set at one or more intermediate operating positions between its closed and fully-open positions in order to regulate the rate and pressure of fluid flow from the valve section annulus into the primary valve (i.e., with the sleeve valve acting as a throttle).

Although the present disclosure refers to specific RSS tool embodiments in which the secondary valve is either a solenoid valve or a sleeve valve, variant embodiments may incorporate other types of valves, whether presently known or developed in the future, that provide the secondary valve functionalities described herein, and such variant embodiments are intended to come within the scope of the present disclosure and the appended claims.

Accordingly, in a first aspect the present disclosure describes a steering tool for drilling deviated wellbores, in which the steering tool has a generally cylindrical tool housing and a longitudinal tool axis, and further comprises:

(a) a steering head having an upper end coaxially and co-rotatingly mountable to the tool housing, a lower end configured for connecting to a drill bit, and a steering head bore extending between said upper and lower ends of the steering head, and further comprising:

two or more steering members arrayed around a circumference of the steering head, with each steering member having a longitudinal side edge pivotably mounted to an outer surface of the steering head;

at each of one or more axially-spaced locations, a bank of two or more primary pistons circumferentially arrayed at a uniform angular spacing, wherein:

when two or more banks of primary pistons are provided, all of the banks of primary pistons have the same number of primary pistons;

each primary piston has a primary piston axis and is reciprocatingly movable within an associated primary piston chamber formed in the steering head, such that each primary piston is outwardly extendable to deflect an associated one of the steering members and thereby to exert a force against a wellbore being drilled by the drill bit; and the steering section defines a plurality of primary fluid supply channels equal in number to the number of primary pistons in each bank of primary pistons, wherein each primary fluid supply channel is in fluid communication with the one or more primary piston chambers at a selected one of the circumferential positions, and extends to the upper end of the steering head for conveying fluid for actuating the primary pistons at the selected circumferential position; and one or more banks of secondary pistons, with the secondary pistons in each bank of secondary pistons being equal in number to the number of steering members, and with each secondary piston having a secondary piston axis and being reciprocatingly movable within an associated secondary piston chamber formed in the steering head, such that each secondary piston is outwardly extendable to outwardly deflect a retraction tab on an associated steering member and thereby to urge the associated steering member toward a retracted position adjacent to the steering head, and wherein the steering head defines a plurality of secondary fluid supply channels equal in number to the number of secondary pistons, wherein each secondary fluid supply channel is in fluid communication with a selected one of the secondary piston chambers and extends to the upper end of the steering head for conveying fluid for actuating the selected secondary piston;

(b) a fluid manifold having an upper end and a lower end, with the lower end of the fluid manifold being coaxially and co-rotatingly mountable to the upper end of the steering head, said fluid manifold defining:

a plurality of primary manifold fluid passages equal in number to the number of steering members, with each primary fluid passage extending between a primary manifold fluid inlet port on the upper end of the fluid manifold and a primary manifold fluid outlet port on the lower end of the fluid manifold, with each primary manifold fluid outlet being in fluid communication with a selected one of the primary fluid supply channels of the steering head;

a plurality of secondary manifold fluid passages equal in number to the number of steering members, with each secondary fluid passage extending between a secondary manifold fluid inlet port on the upper end of the fluid manifold and a secondary manifold fluid outlet port on the lower end of the fluid manifold, with each secondary manifold fluid outlet being in fluid communication with a selected one of the secondary fluid supply channels of the steering head; and one or more fluid bypass channels extending between an upper region of the fluid manifold and the lower end of the fluid manifold;

(c) a valve section disposed within the tool housing, said valve section defining a valve section annulus between the valve section and the tool housing, and comprising:

a rotationally geostationary primary valve defining a fluid chamber proximal to a lower end of the primary valve, with said lower end of the primary valve being engageable with the upper end of the fluid manifold such that the fluid chamber will be in fluid communication with the manifold fluid inlet ports; and a secondary valve disposed within the tool housing and configured to divert a portion of a fluid flow through the valve section annulus and to deliver the diverted fluid flow to the primary valve;

wherein the primary valve comprises co-rotating flow restriction means configured to restrict the number of manifold fluid inlets in fluid communication with the fluid chamber at any given time as the fluid manifold and the steering head rotate relative to the primary valve, and wherein a non-diverted portion of the fluid flow in the valve section annulus can flow into the steering head bore via the one or more fluid manifold bypass channels.

In a second aspect the present disclosure describes a steering tool for drilling deviated wellbores, in which the steering tool has a generally cylindrical tool housing and a longitudinal tool axis, and further comprises:

(a) a steering head having an upper end coaxially and co-rotatingly mountable to the tool housing, a lower end configured for connecting to a drill bit, and a steering head bore extending between said upper and lower ends of the steering head, and further comprising, at each of one or more axially-spaced locations, a bank of two or more pistons circumferentially arrayed at a uniform angular spacing, wherein:

when two or more banks of pistons are provided, all of the banks of pistons have the same number of pistons, and the circumferential positions of the pistons relative to the steering head are the same in all of the banks of pistons;

each piston has a piston axis and is reciprocatingly movable within an associated piston chamber formed in the steering head, such that each piston is outwardly extendable to exert a force against a wellbore being drilled by the drill bit; and the steering head defines a plurality of fluid supply channels equal in number to the number of pistons in each bank of pistons, wherein each fluid supply channel is in fluid communication with the one or more piston chambers at a selected one of the circumferential positions, and extends to the upper end of the steering head for conveying fluid for actuating the pistons at the selected circumferential position;

(b) a fluid manifold having an upper end and a lower end, with the lower end of the fluid manifold being coaxially and co-rotatingly mountable to the upper end of the steering head, said fluid manifold defining:

a plurality of manifold fluid passages equal in number to the number of pistons in each bank of pistons, with each manifold fluid passage extending between a manifold fluid inlet port on the upper end of the fluid manifold and a manifold fluid outlet port on the lower end of the fluid manifold, with each manifold fluid outlet being in fluid communication with a selected one of the plurality of fluid supply channels of the steering head; and one or more fluid bypass channels extending between an upper region of the fluid manifold and the lower end of the fluid manifold; and (c) a valve section disposed within the tool housing, said valve section defining a valve section annulus between the valve section and the tool housing, and comprising:

a rotationally geostationary primary valve defining a fluid chamber proximal to a lower end of the primary valve, with said lower end of the primary valve being engageable with the upper end of the fluid manifold such that the fluid chamber will be in fluid communication with the manifold fluid inlet ports; and a secondary valve disposed within the tool housing and configured to divert a portion of a fluid flowing through the valve section annulus and to deliver the diverted fluid to the primary valve;

wherein the primary valve comprises co-rotating flow restriction means configured to restrict the number of manifold fluid inlets in fluid communication with the fluid chamber at any given time as the fluid manifold and the steering head rotate relative to the primary valve, and wherein a non-diverted portion of the fluid flowing in the valve section annulus can flow into the steering head bore via the one or more fluid manifold bypass channels.

BRIEF DESCRIPTION OF THE DRAWINGS

Embodiments in accordance with the present disclosure will now be described with reference to the accompanying Figures, in which numerical references denote like parts, and in which.

DESCRIPTION

Figure 1:
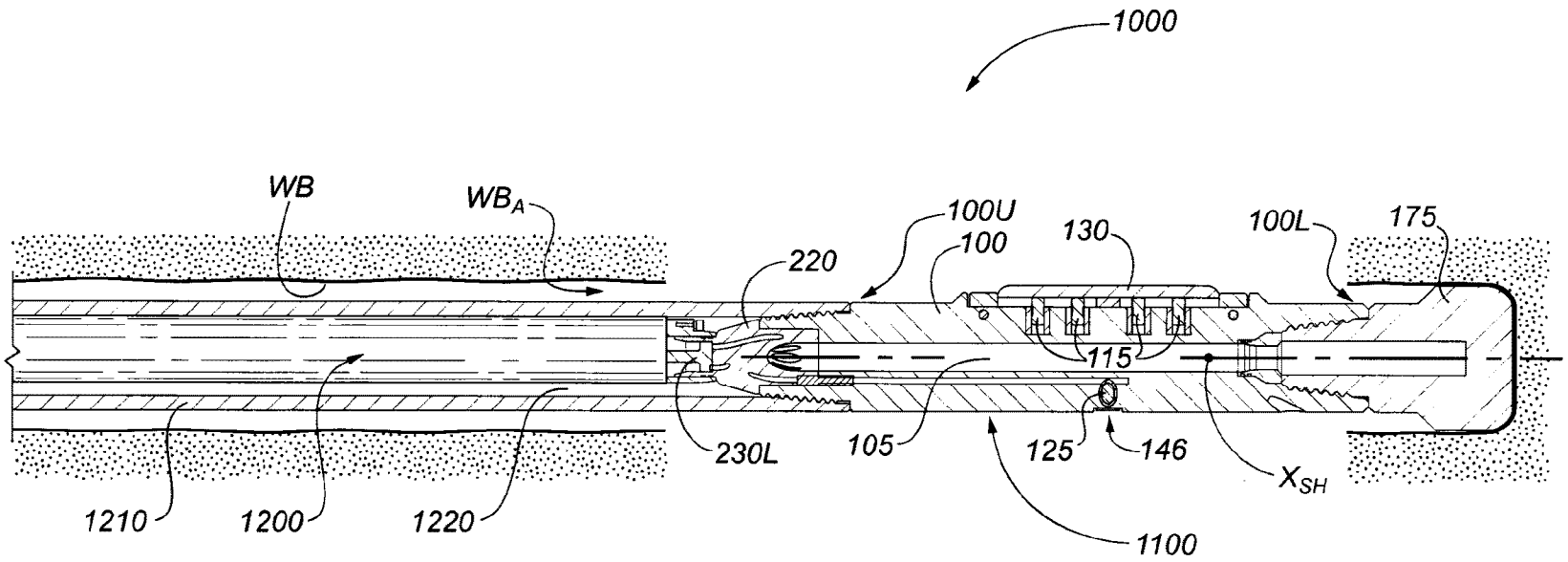
FIG. 1 is a sectional general arrangement view of the valve section and steering section of an embodiment of a rotary steerable system (RSS) tool in accordance with the present disclosure, showing a drill bit mounted to the lower end of the steering section and forming a wellbore in a subsurface formation.

FIG. 1 is a cross-sectional general arrangement view a steering section 1100 and a hydraulics section ("valve section") 1200 of an embodiment 1000 of a rotary steerable system (RSS) tool in accordance with the present disclosure, deployed at the lower end of a drill string (not shown) and operating within a wellbore WB (shown for illustration purposes as a horizontal wellbore) having a wellbore annulus $WB_A$. Steering section 1100 comprises an elongate and generally cylindrical steering head 100 having a longitudinal steering head axis $X_{SH}$ and a steering head bore 105 throughout its length, with steering head bore 105 being in fluid communication with a drill bit 175 mounted to the lower end 100L of steering head 100, and in fluid communication with a fluid manifold 220 co-rotatingly mounted to the upper end 100U of steering head 100.

As explained in further detail later herein (and as further illustrated in FIGS. 12, 12A,12B,14A, and 14B), valve section 1200 has a valve section housing 1210 and defines a valve section annulus 1220, and further comprises:

- a primary valve 230 having a lower end 230L and being positioned above and in operative engagement with a fluid manifold 220 such that fluid discharged from primary valve 230 into a fluid chamber 233 proximal to lower end 230L of primary valve 230 will be directed through the fluid manifold to steering head 100 (as explained in greater detail later herein); and
- a secondary valve 240 positioned above and in fluid communication with primary valve 230.

Primary valve 230 is controllable by an instrumentation section (not shown) so as to be rotationally geostationary regardless of rotation of steering head 100 and the fluid manifold, by means of a motor/actuator assembly 232 that rotates primary valve 230 within valve section housing 1210 at the same rotational rate as the drill string but in the opposite direction.

In the particular embodiment shown in FIGS. 2, 3, 3A, 4, 4A, 5, and 6, steering head 100 has four axially-spaced banks of three primary piston chambers, with each bank comprising primary piston chambers 110A, 110B, and 110C, arrayed at equal angular intervals about steering head axis $X_{SH}$, and with each primary piston chamber having a primary piston axis ($X1_A$, $X1_B$, or $X1_C$, as the case may be). Primary pistons 115A, 115B, and 115C are respectively disposed within primary piston chambers 110A, 110B, and 110C. As best seen in FIGS. 3, 3A, 4, and 4A, primary piston chambers 110A, 110B, and 110C are respectively in fluid communication with associated primary fluid supply channels 142A, 142B, and 142C into which circulating pressurized drilling fluid may be selectively diverted via primary valve 230 and fluid manifold 220 to sequentially and individually extend primary pistons 115A, 115B, and 115C radially outward from their respective primary piston chambers 110A, 110B, and 110C.

Figure 4:
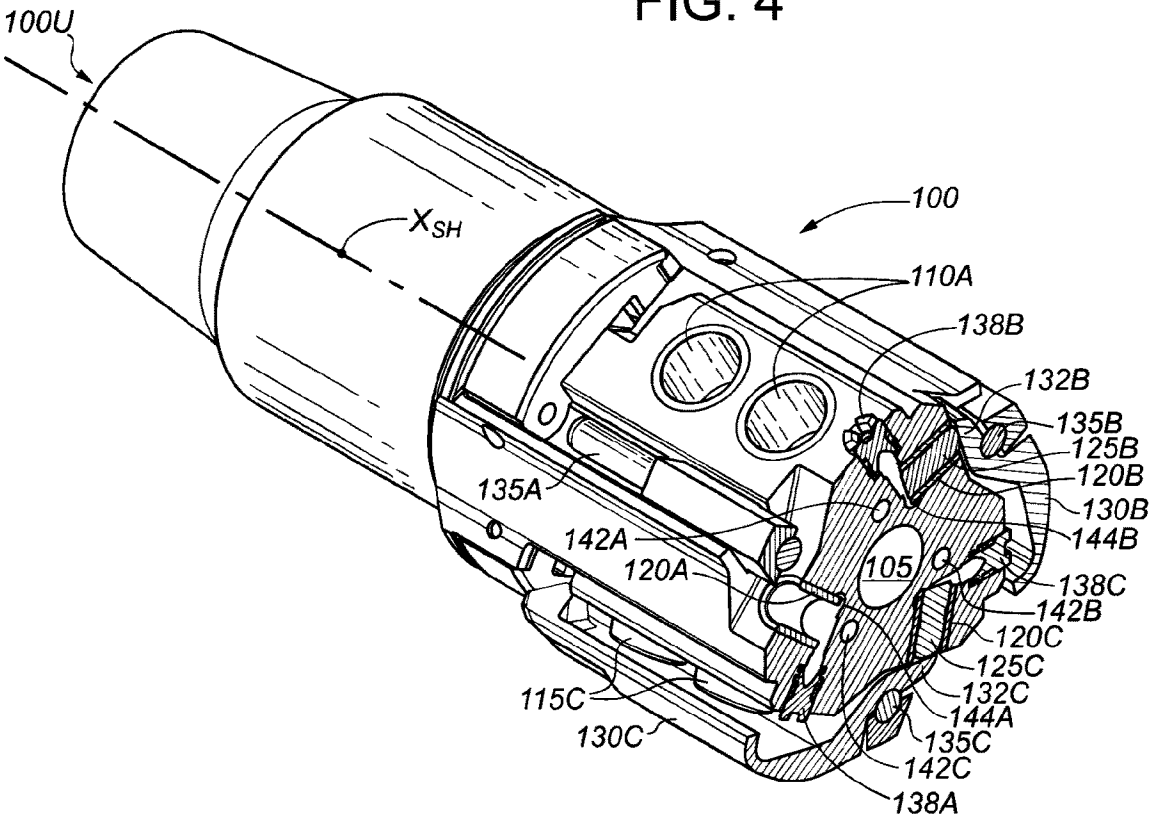
FIG. 4 is an isometric view similar to FIG. 2, but with the steering head transversely sectioned through the bank of secondary pistons of the steering bead.
Figure 4A:
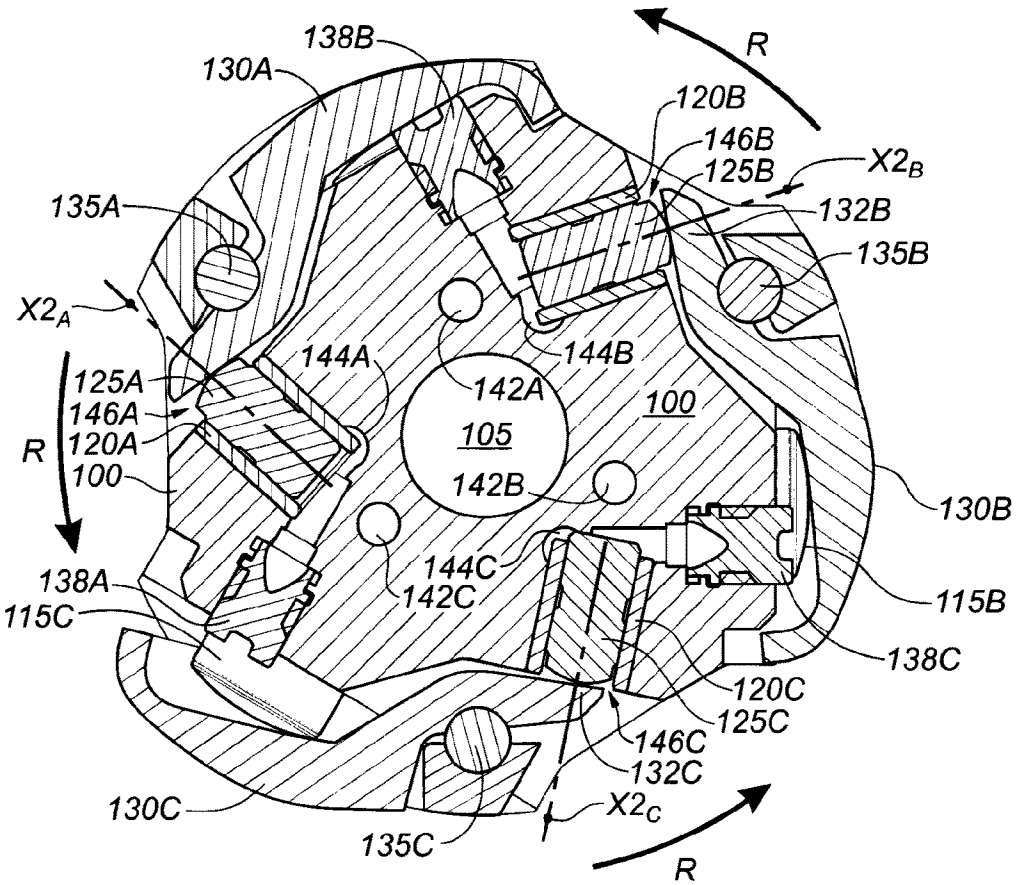
FIG. 4A is an enlarged transverse section through the steering head at the bank of secondary pistons as shown in isometric view in FIG. 4, with the wellbore not shown).
Figure 5:
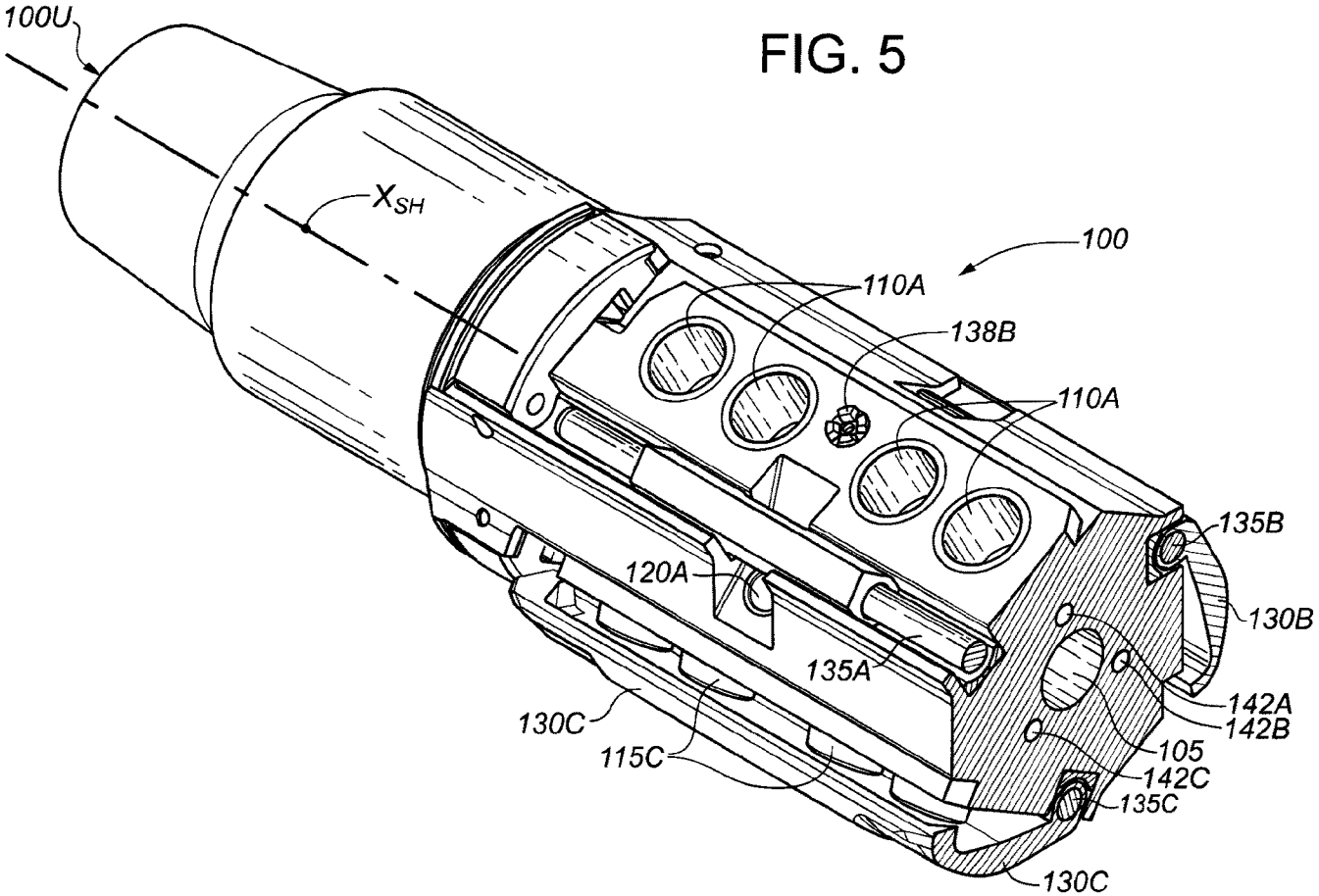
FIG. 5 is an isometric view similar to FIG. 2, but with the steering head transversely sectioned on a plane immediately below the clamshell steering members.

In the illustrated embodiment, steering head 100 is also shown with one bank of three secondary piston chambers 120A, 120B, and 120C, arrayed at equal angular intervals about steering head axis $X_{SH}$, and with each secondary piston chamber having a secondary piston axis ($X2_A$, $X2_B$, or $X2_C$, as the case may be). Secondary pistons 125A, 125B, and 125C are respectively disposed within secondary piston chambers 120A, 120B, and 120C. By way of non-limiting example, the bank of secondary piston chambers 120A, 120B, and 120C is shown axially located between the second and third of the four banks of primary piston chambers 110A, 110B, and 110C. As best seen in FIGS. 4 and 4A, secondary piston chambers 120A, 120B, and 120C are respectively in fluid communication with associated secondary fluid supply channels 144A, 144B, and 144C into which circulating pressurized drilling fluid may be diverted via primary valve 230 via fluid manifold 220 to sequentially and individually extend secondary pistons 125A, 125B, and 125C radially outward from their respective secondary piston chambers 120A, 120B, and 120C.

In the illustrated embodiment, three "clamshell-style" steering members 130A, 130B, and 130C are mounted along their respective inner longitudinal edges 131A, 131B, and 131C to steering head 100 so as to be pivotable about pivot axes associated with respective pivot pins 135A, 135B, and 135C retained by steering head 100. As may be appreciated from FIG. 3A, a flow of pressurized fluid into any one of primary fluid supply channels 142A, 142B, and 142C will actuate the associated primary piston (115A, 115B, or 115C as the case may be) to urge the associated steering member (130A, 130B, or 130C as the case may be) to pivot outward from steering head 100 and into compressive contact with the surface of wellbore WB.

Figure 3:
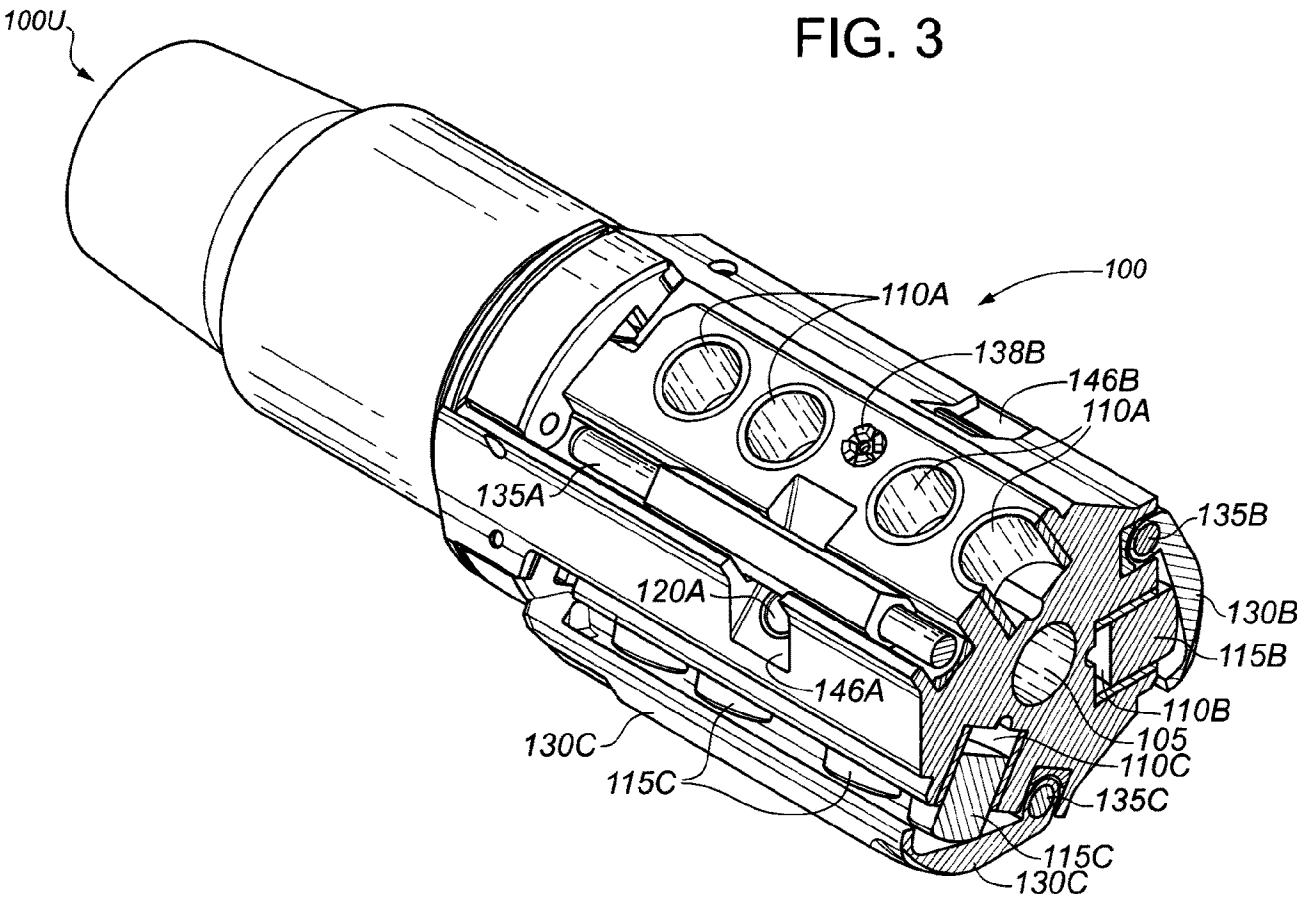
FIG. 3 is an isometric view similar to FIG. 2, but with the steering head transversely sectioned through a representative bank of primary pistons of the steering head.
Figure 3A:
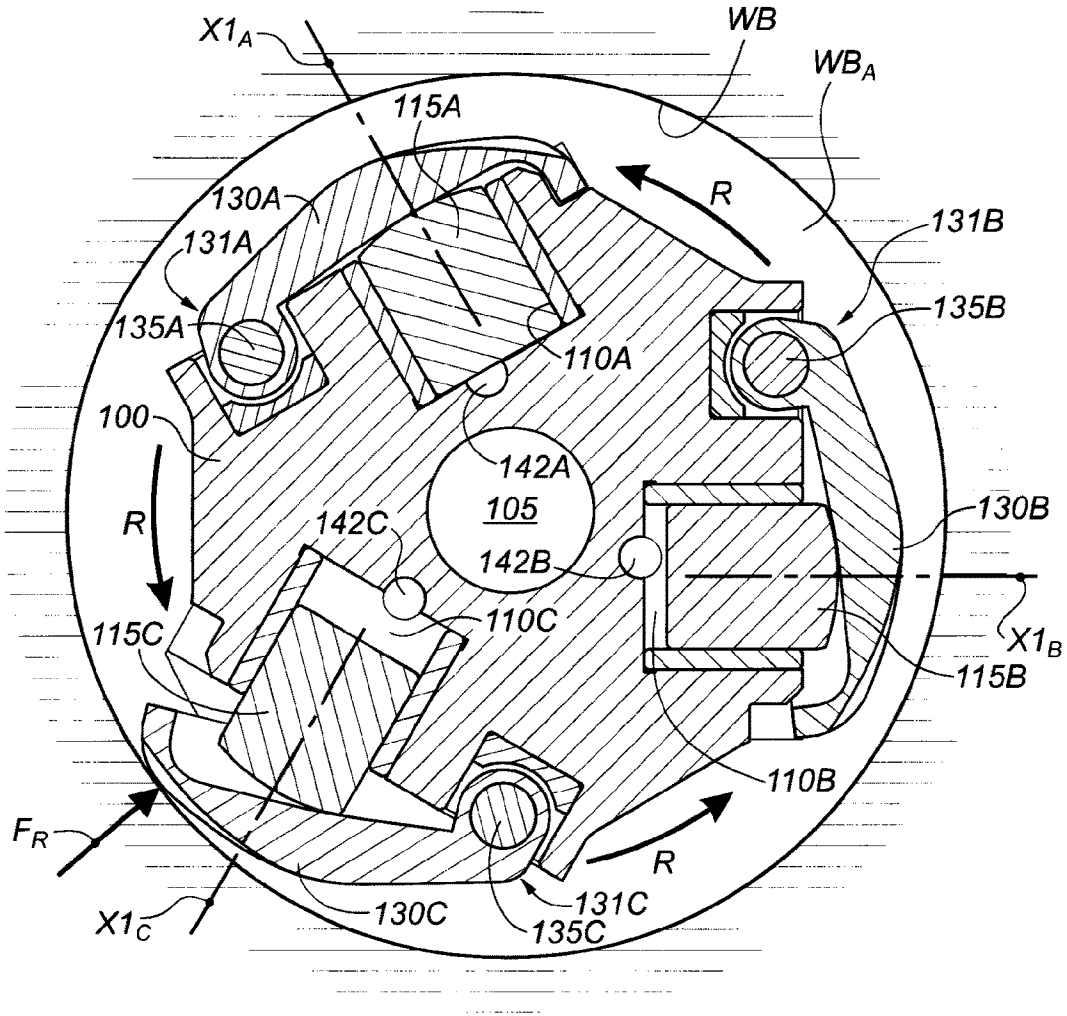
FIG. 3A is an enlarged transverse section through the steering head at a representative bank of primary pistons (as shown in isometric view in FIG. 3), as the steering head would appear during the drilling of a wellbore.

As an illustrative example, FIG. 3A shows steering member 130C (momentarily being the "operative steering member") deflected into compressive contact with wellbore WB by the actuation of primary piston 115C, as conceptually denoted by arrow $F_R$ indicating the corresponding reaction force resisted by wellbore WB and tending to deflect steering head 100 in the direction of arrow $F_R$. As conceptually denoted by rotational direction arrows R, steering head 100 is rotating relative to wellbore WB, and steering member 130C is shown in an intermediate position as it pivots about its pivot axis toward its retracted position (just after having been the operative steering member). Meanwhile, steering member 130A is shown in its fully retracted position and ready to become the operative steering member again after a further 120-degree rotation of steering head 100.

Figure 2:
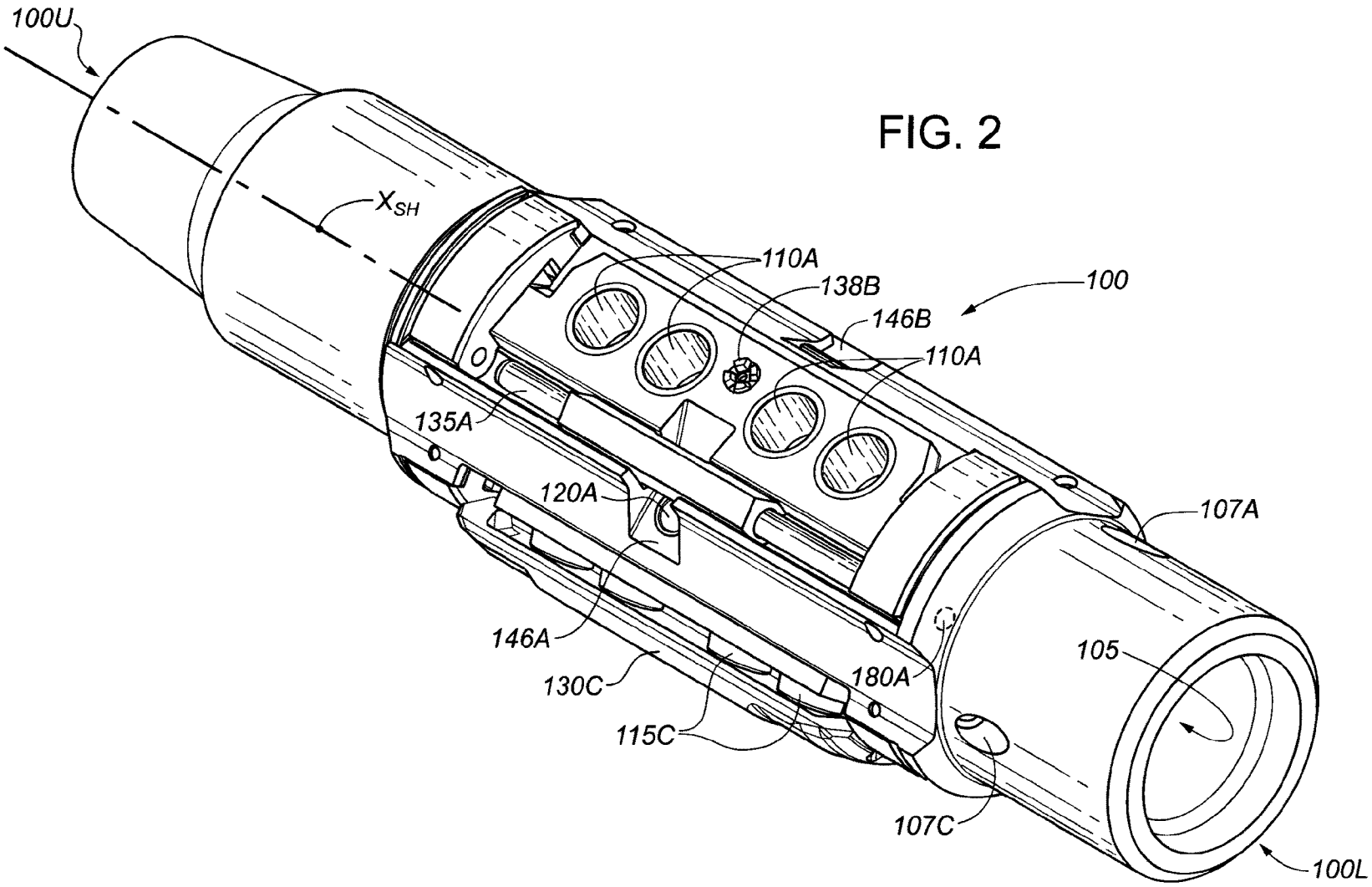
FIG. 2 is an isometric view of the steering section ("steering head") of an RSS tool generally as illustrated in FIG. 1, shown with one clamshell-type steering member removed to facilitate illustration of internal features.
Figure 6:
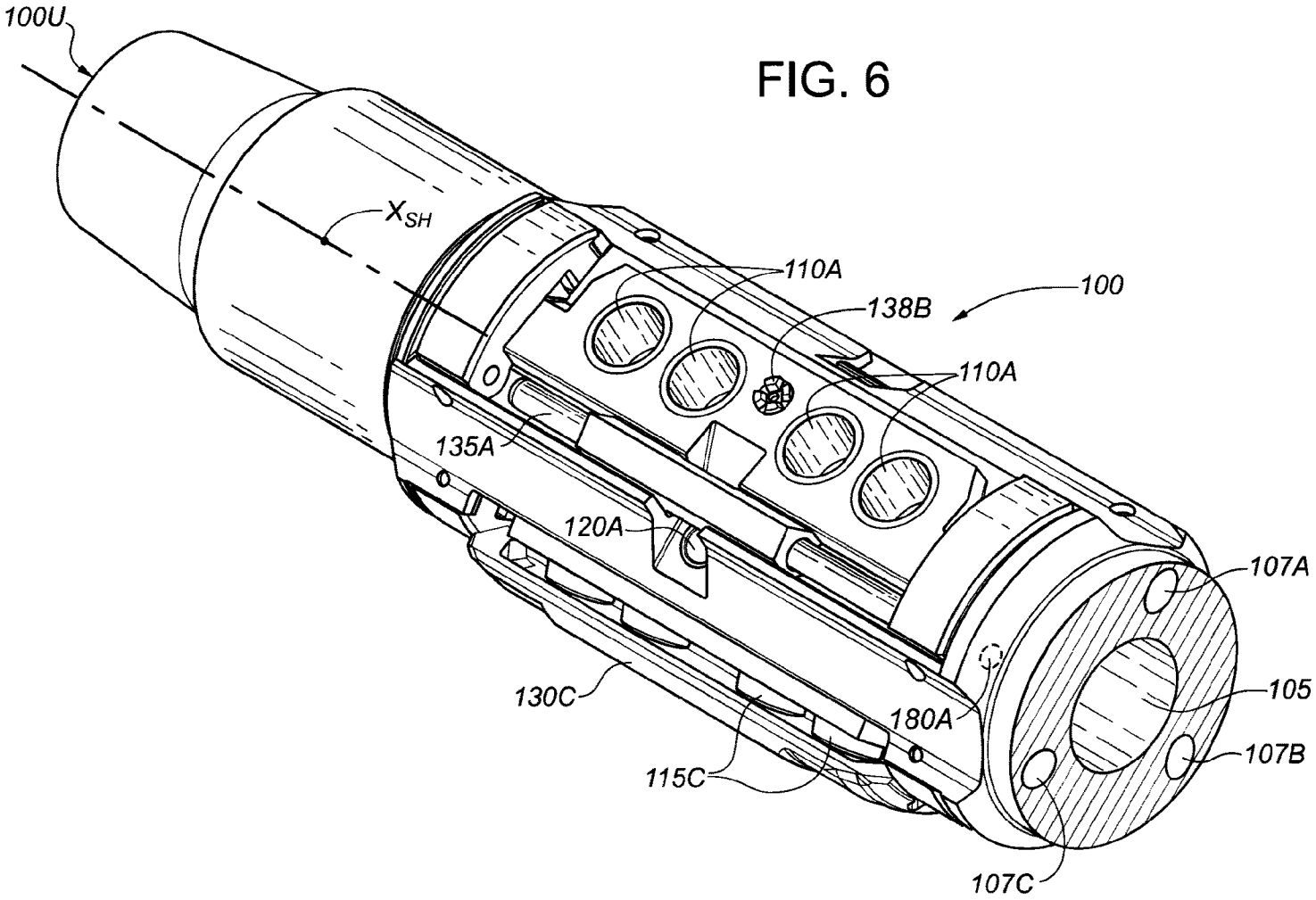
FIG. 6 is an isometric view similar to FIG. 5, but with the steering head transversely sectioned on a plane through an upper region of the lower (box) end of the steering head.

As may be seen in FIGS. 2 and 6, steering head 100 defines primary fluid exhaust channels 107A, 107B, and 107C which are in fluid communication, respectively, with primary fluid supply channels 142A, 142B, and 142C to exhaust actuating fluid from primary piston chambers 110A, 110B, and 110C during the retraction cycles of primary pistons 115A, 115B, and 115C.

As most clearly seen in FIGS. 4 and 4A, each of steering members 130A, 130B, and 130C has a steering member retraction tab or "tailpiece" 132A, 132B, or 132C (as the case may be) extending from its inner longitudinal edge 131A, 131B, or 131C (as the case may be) but in the direction generally away the steering member's clamshell structure. In the illustrated embodiment, tailpieces 132A, 132B, and 132C are positioned for respective operative engagement with secondary pistons 125A, 125B, and 125C. As may be appreciated from FIG. 4A, a flow of pressurized fluid into any one of secondary fluid supply channels 144A, 144B, and 144C will actuate the associated secondary piston (125A, 125B, or 125C as the case may be) to push outward against the associated tailpiece (132A, 132B, or 132C as the case may be) to urge the associated steering member (130A, 130B, or 130C as the case may be) to pivot inward toward its retracted position adjacent to steering head 100.

As an illustrative example, FIG. 4A shows steering member 130B being actively transitioned it from its fully-deflected position toward its fully-retracted position by the actuation of secondary piston 125B. In this view, steering member 130C is the current operative steering member (as in FIG. 3A) and therefore is in its fully-extended position, with tailpiece 132C is in a retracted position (within a tailpiece retraction pocket 146C formed in adjacent to steering head 100), and with secondary piston 125C fully retracted within secondary piston chamber 120C. Meanwhile, with steering member 130A being fully retracted (as in FIG. 3A), tailpiece 132A and secondary piston 125A are in their fully extended positions.

As steering head 100 rotates further, the actuation of primary piston 115A to deflect steering member 130A into the operative position will cause tailpiece 132A to urge secondary piston 125A toward its retracted position within secondary piston chamber 120A. The retraction of secondary piston 125A will in turn exhaust the actuating fluid from secondary piston chamber 120A via a secondary fluid exhaust nozzle 138A discharging underneath steering member 130A. As shown in FIG. 4A, additional secondary fluid exhaust nozzles 138B and 138C are also provided for exhausting actuating fluid from secondary piston chambers 120B and 120C respectively.

In alternative embodiments, actuating fluid may be exhausted from secondary piston chambers 120A, 120B, and 120C into respective secondary fluid exhaust channels (not illustrated) that discharge into wellbore annulus $WB_A$ via fluid exhaust nozzles located below the steering members (as generally denoted by reference number 180 on FIGS. 2 and 6), rather than being located under the associated steering members.

In an unillustrated alternative embodiment, the steering head does not have pivoting steering members (pads) as described above. Instead, the primary pistons are configured for direct compressive contact against wellbore WB. In this alternative embodiment, the primary pistons are hydraulically dependent, meaning that all of the primary pistons at each angular interval around steering head 100 (e.g., all of the primary pistons 115A, all of the primary pistons 115B, etc.) extend or retract in "lockstep" with each other. (This may also be the case for the primary pistons in the illustrated embodiments that have steering members, but in such embodiments it is not essential for all of the primary pistons that actuate a given steering member to operate in lockstep.) In such alternative embodiments that do not include pivoting steering members, there will of course be no need for any secondary pistons or components appurtenant thereto.

Figures 7, 8:
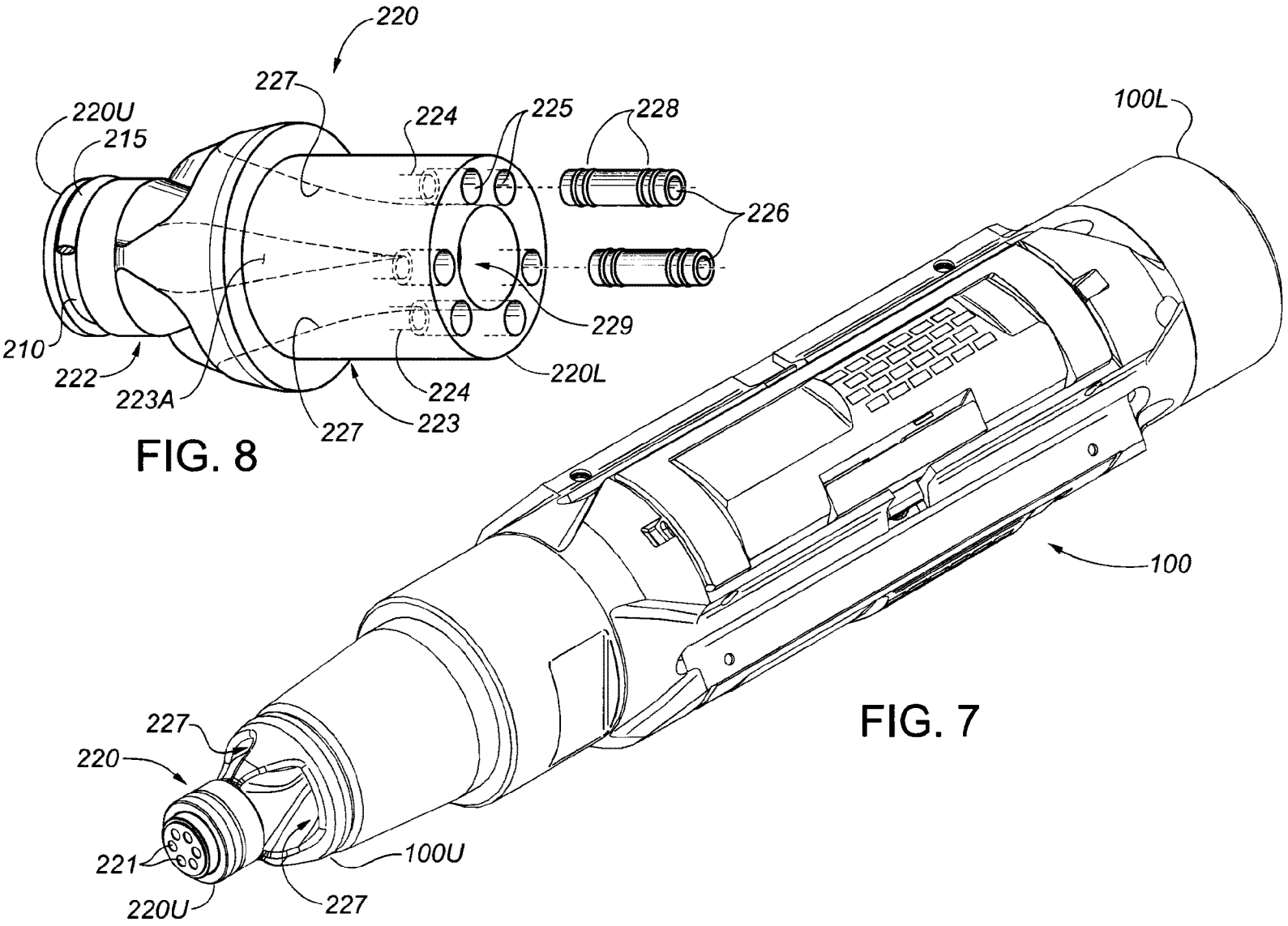
FIG. 7 is an isometric view of a steering head similar to the steering head in FIG. 2, shown with an embodiment of a fluid manifold co-rotatingly mounted to the upper end of the steering head.
FIG. 8 is an enlarged partially-exploded isometric view of a fluid manifold as in FIG. 7, illustrating exemplary fluid flow sleeve connectors insertable into the manifold fluid outlet ports and into the associated fluid supply channels in the steering head, so as to rotationally anchor the fluid manifold to the steering head while providing continuity of fluid flow to the primary and secondary piston banks.
Figure 10:
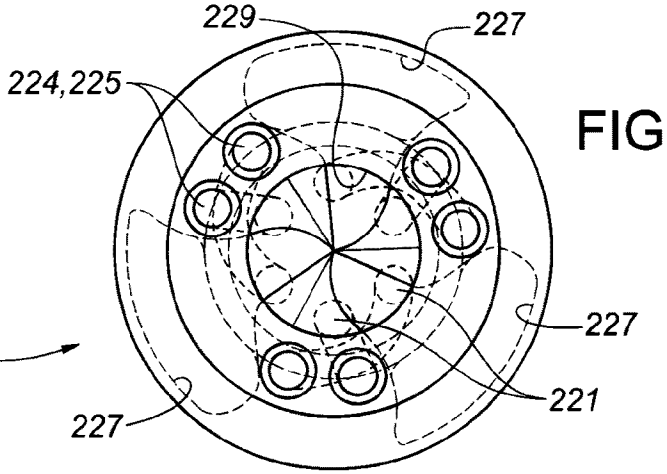
FIG. 10 is an axial view of the lower end of the fluid manifold in FIG. 9, illustrating the fluid outlet ports and fluid bypass channels of the fluid manifold.
Figure 9:
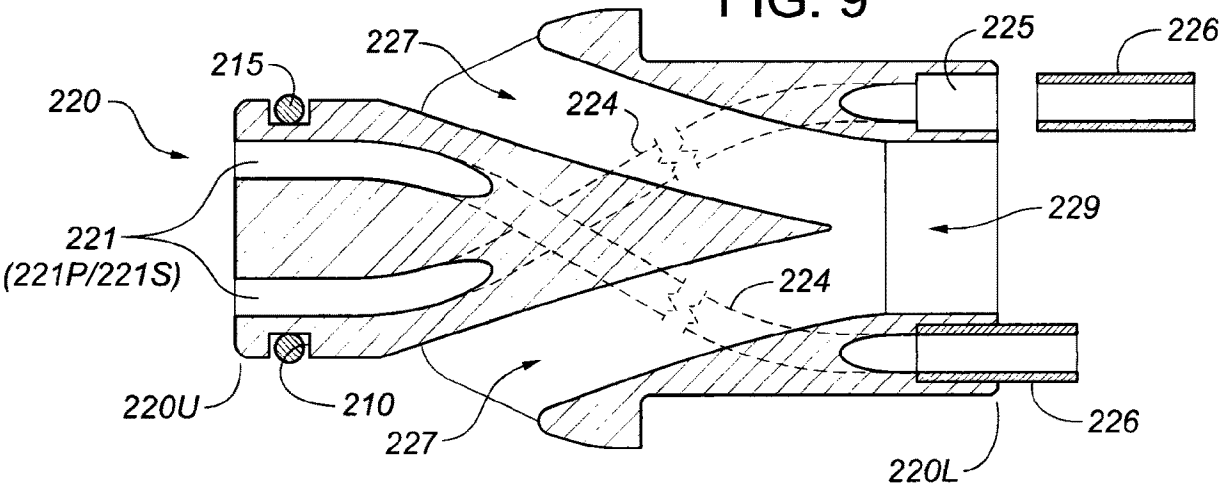
FIG. 9 is a cross-section through the fluid manifold shown in FIG. 7, generally illustrating the fluid flow channels extending between the fluid manifold's fluid inlet and outlet ports, and illustrating the fluid bypass channels extending through the fluid manifold to convey non-diverted fluid from the valve section annulus to the bore of the steering head, and thus bypassing the steering head's steering mechanism.

FIG. 7 illustrates an exemplary embodiment of fluid manifold 220 mounted to upper end 100U of steering head 100. As further illustrated in FIGS. 8 to 11, fluid manifold 220 has an upper end 220U, a lower end 220L, an upper portion 222, and a lower portion 223 having a cylindrical outer surface 223A and being receivable in a cylindrical "box" on upper end 220U of fluid manifold 220. As may be seen in FIGS. 12B and 16B, upper end 222 of fluid manifold 220 is receivable in a cylindrical manifold receiver 237 on lower end 230L of primary valve 230. In the illustrated embodiment of fluid manifold 220, a seal element in the form of an O-ring 215 is carried in an annular seal groove 210 on upper section 222 of fluid manifold 220, for sealing against an inner surface of manifold receiver 237. This is by way of non-limiting example only; in variant embodiments, the seal element could be carried in a seal groove on an inner surface of manifold receiver 237. As best seen in FIG. 9, fluid manifold 220 also defines a plurality of manifold fluid bypass channels 227 that merge to form a manifold fluid bypass outlet 229 on lower end 220L of 220, such that when fluid manifold 220 is mounted to steering head 100, manifold fluid bypass outlet 229 will be in fluid communication with steering head bore 105.

Figure 11:
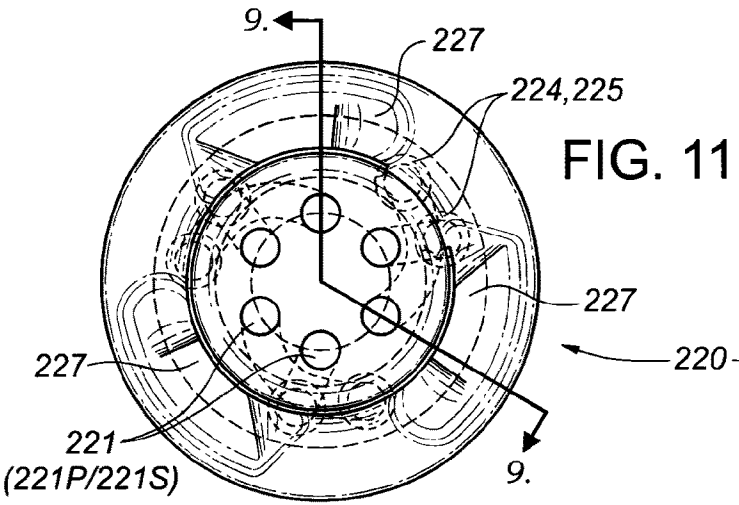
FIG. 11 is an axial view of the upper end of the fluid manifold in FIG. 9, further illustrating the fluid inlet ports and fluid bypass channels of the fluid manifold.

As shown in FIG. 11 (and in faint outline in FIG. 10), upper end 220U of exemplary fluid manifold 220 has six manifold fluid inlet ports 221 for receiving fluid from primary valve 230. Three of the manifold fluid inlet ports 221 (which may be referred to as primary manifold fluid inlet ports 221P) direct fluid flow into primary fluid supply channels 142A, 142B, and 142C in steering head 100, via associated manifold fluid passages 224 (or 224P) and manifold fluid outlet ports 225 (or 225P); and the other three fluid inlet ports 221 (which may be referred to as secondary fluid inlet ports 221S) direct fluid flow into secondary fluid supply channels 144A, 144B, and 144C in steering head 100, via associated manifold fluid passages 224 (or 224S) and manifold fluid outlet ports 225 (or 225S).

Referring again to FIGS. 8 and 9, flow sleeves 226 are insertable into manifold fluid outlet ports 225 and also into the upper ends of fluid supply channels 142 and 144 in steering head 100, serving the dual functions of rotationally anchoring fluid manifold 220 to steering head 100 and providing continuity of fluid flow from manifold fluid passages 224 into fluid supply channels 142 and 144. As shown in FIG. 8, sealing means such as O-rings 226 are preferably provided on both ends of flow sleeves 226 to prevent fluid leakage and loss of fluid pressure. Manifold fluid outlet ports 225 and upper portions of fluid supply channels 142 and 144 preferably have enlarged bores (as shown in FIGS. 8-11 with respect to manifold fluid outlet ports 225) such that the inside diameter of flow sleeves 226 can match the inside diameter of manifold fluid passages 224 and fluid supply channels 142 and 144.

Figure 13:
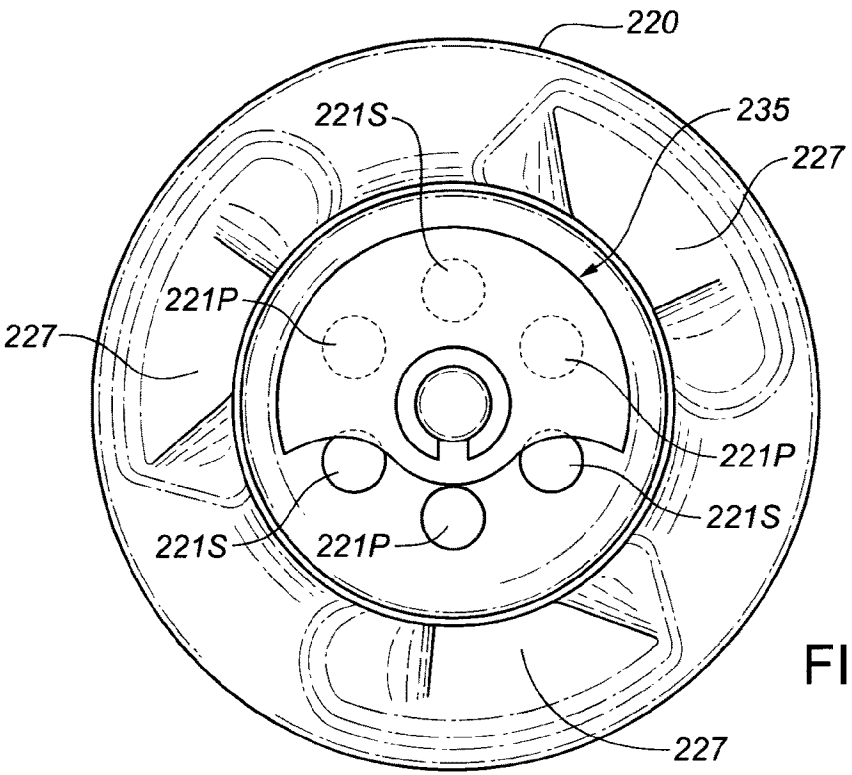
FIG. 13 is a transverse section through an upper region of the primary valve in FIG. 12B, illustrating an exemplary embodiment of a flow restrictor co-rotatingly mounted to the upper end of the primary valve and configured to restrict the number of manifold fluid inlets into which diverted fluid can flow at any given time as the manifold and the steering section rotate relative to the primary valve.

As indicated by way of general example in FIG. 13, primary and secondary manifold fluid inlet ports 221P and 221S are arrayed in an alternating pattern such that when a given primary manifold fluid inlet port 221P is receiving fluid flow from primary valve 230, thereby actuating (deflecting) the associated steering member 130 (which temporarily becomes the "operative steering member"), an adjacent secondary fluid inlet port 221S will receive fluid flow to actuate (extend) the secondary piston 125 in steering head 100 to actively close the steering member 130 that was just previously the operative steering member. To facilitate and enable this functionality, a flow-restricting element (alternatively, "flow restrictor") 235 is co-rotatingly mounted to lower end 230L of primary valve 230, and configured to limit the number of fluid inlet ports 221 that are exposed to fluid flowing in fluid chamber 233 of primary valve 230 at any given time.

FIG. 13 illustrates an exemplary and non-limiting embodiment of such a flow restrictor 235, configured to expose no more than three fluid inlet ports 221. As fluid manifold 220 (and steering head 100) rotate relative to primary valve (and flow restrictor 235) in this particular embodiment, the number of fluid inlet ports 221 exposed by flow restrictor 235 will decrease from three to two, and then will increase to three as a different fluid inlet port 221 becomes exposed, and then will again decrease to two, and so on as relative rotation continues. Accordingly, the direction in which the "operative steering member" exerts force against the wellbore will remain constant for a given operational set-up of the RSS tool.

Figure 12:
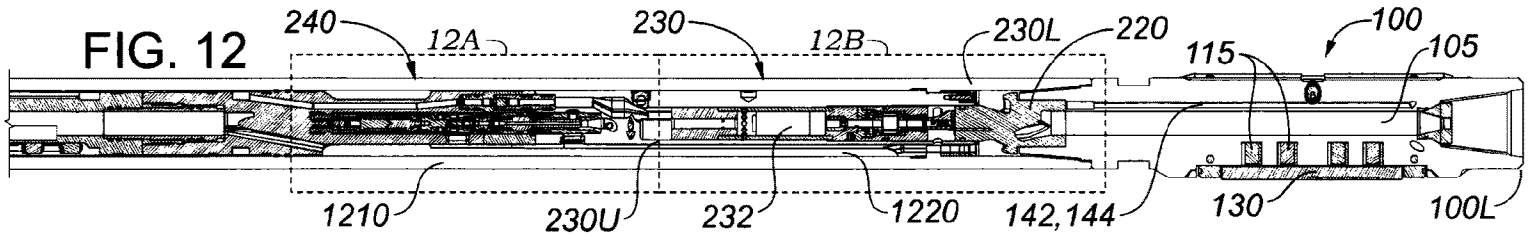
FIG. 12 is a longitudinal section illustrating an exemplary embodiment of an RSS valve section in accordance with the present disclosure, comprising a rotationally geostationary primary valve in operative engagement with a fluid manifold co-rotatingly mounted to a steering section generally as shown in FIG. 7, and further comprising a secondary valve shown by way of non-limiting example as a solenoid valve disposed above the primary valve.
Figure 12A:
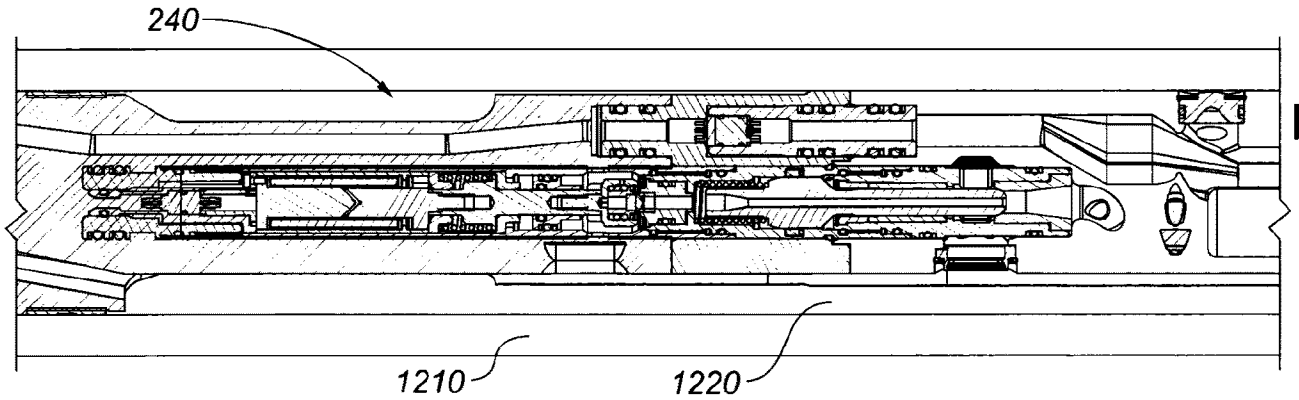
FIG. 12A is an enlarged longitudinal section through the secondary valve and fluid manifold shown in FIG. 12.
Figure 12B:
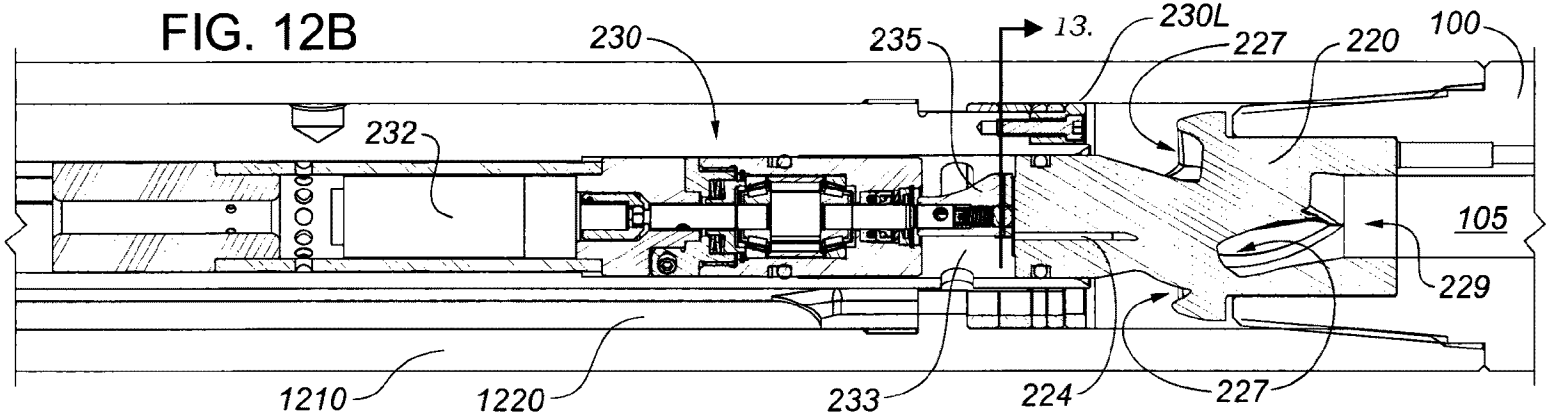
FIG. 12B is an enlarged longitudinal section through the primary valve shown in FIG. 12.
Figure 14A:
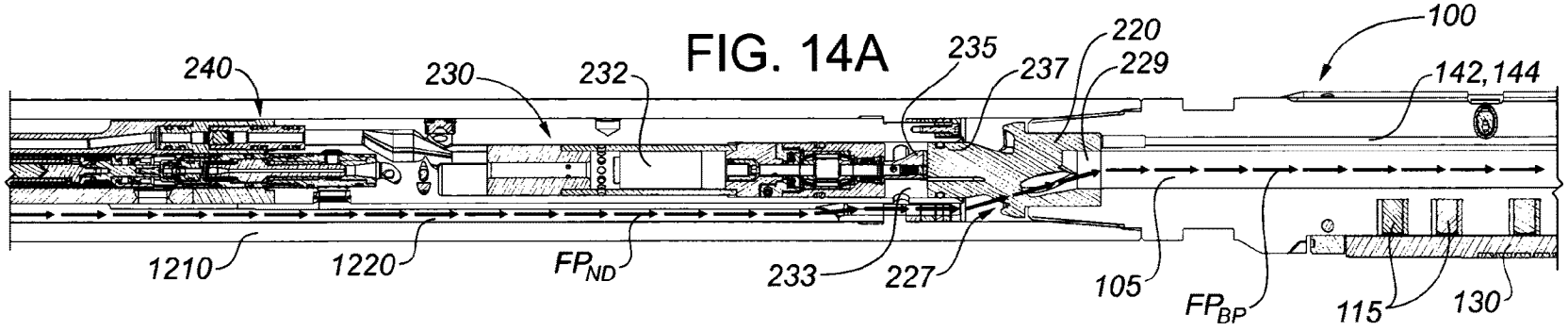
FIG. 14A is a longitudinal section generally similar to FIG. 12, shown with the secondary (solenoid) valve in the closed position such that all fluid flow through the valve section annulus bypasses the primary valve and flows into the steering head bore via the bypass channels of the fluid manifold.
Figure 14B:
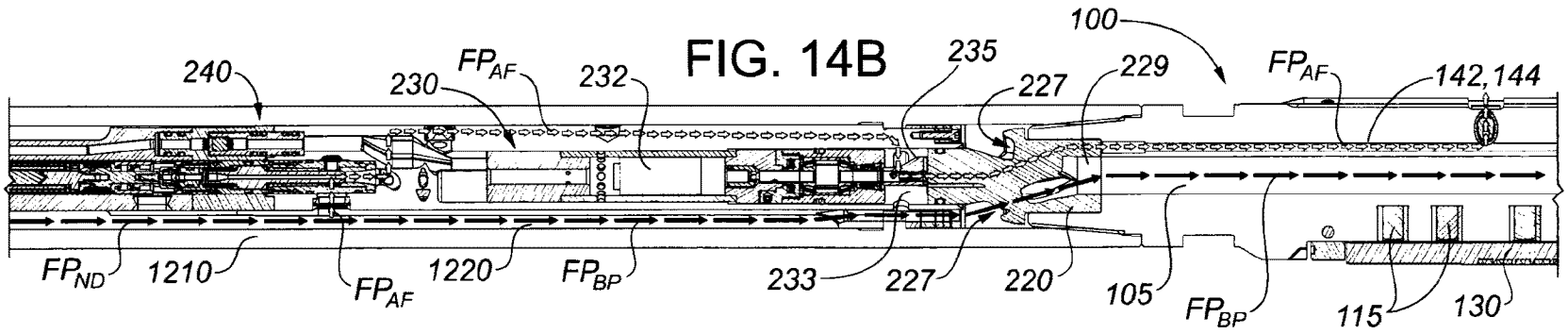
FIG. 14B is a longitudinal section generally similar to FIG. 14A, but shown with the secondary (solenoid) valve in the open position such that a portion of the fluid flowing through the valve section annulus is diverted into the secondary valve, then flows into the primary valve and into the primary fluid supply channels of the steering head, via the fluid manifold, to actuate the steering head pistons, while an undiverted portion of the fluid flowing through the valve section annulus flows into the steering head bore via the bypass channels of the fluid manifold.

FIGS. 12, 12A, and 12B are longitudinal sections through an exemplary RSS tool embodiment in which secondary valve 240 is provided in the form of a solenoid valve positioned above primary valve 230. FIGS. 14A and 14B are similar to FIGS. 12A and 12B, but further indicate fluid flow paths represented by:

- flow path arrows $FP_{ND}$ denoting non-diverted downward fluid flow through valve section annulus 1220;
- flow path arrows $FP_{BP}$ denoting fluid flow bypassing the steering system via manifold fluid bypass channels 227 and steering head bore 105 and onward to the drill bit; and
- flow path arrows $FP_{AF}$ denoting actuating fluid flow diverted into secondary valve 240 and thence into primary and secondary fluid supply channels 142 and 144 in steering head 100 via primary valve 230 and fluid manifold 220, to actuate primary and secondary pistons 115 and 125.

Figure 15:
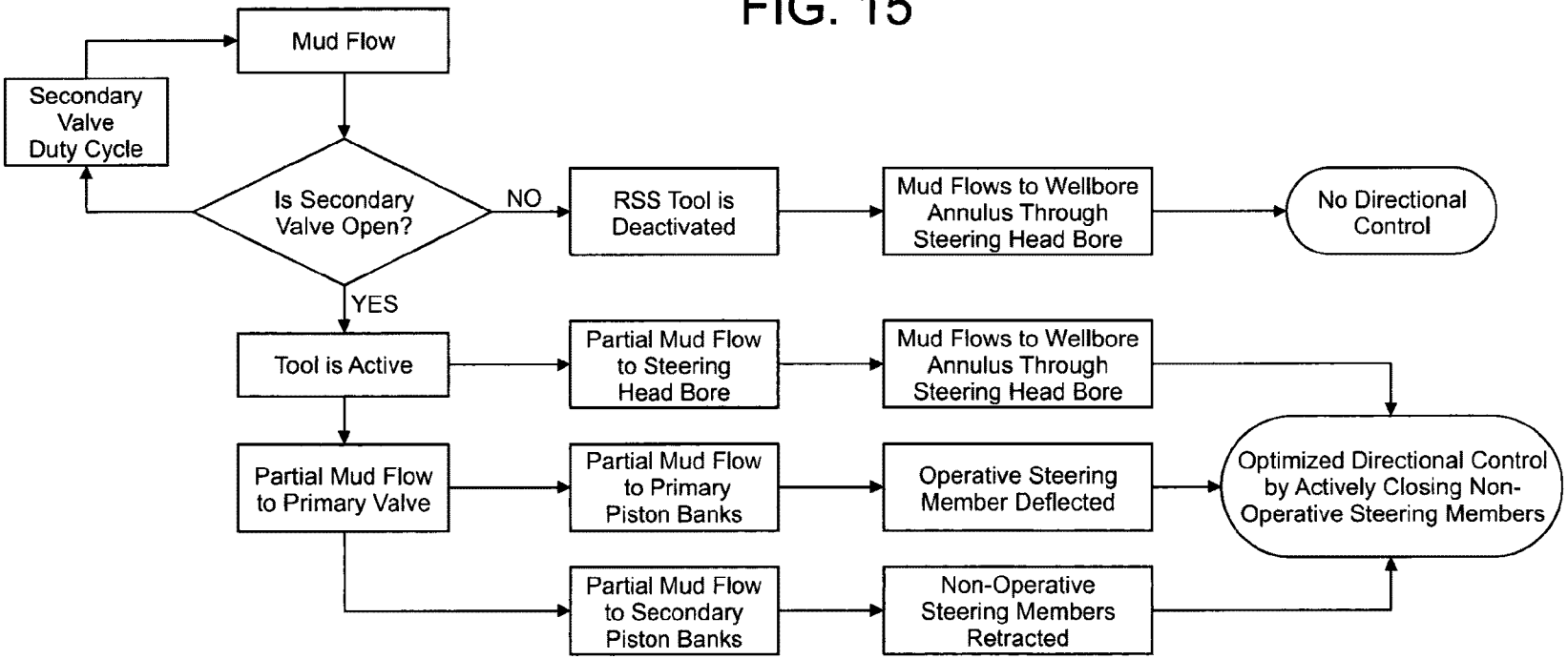
FIG. 15 is a flow chart illustrating operative states of the RSS tool according to the whether the secondary valve is open or closed.

FIG. 15 is a flow chart illustrating the operative states of RSS tool embodiments as shown in FIGS. 14A and 14B, according to the whether the secondary valve is open or closed.

Figure 16A:
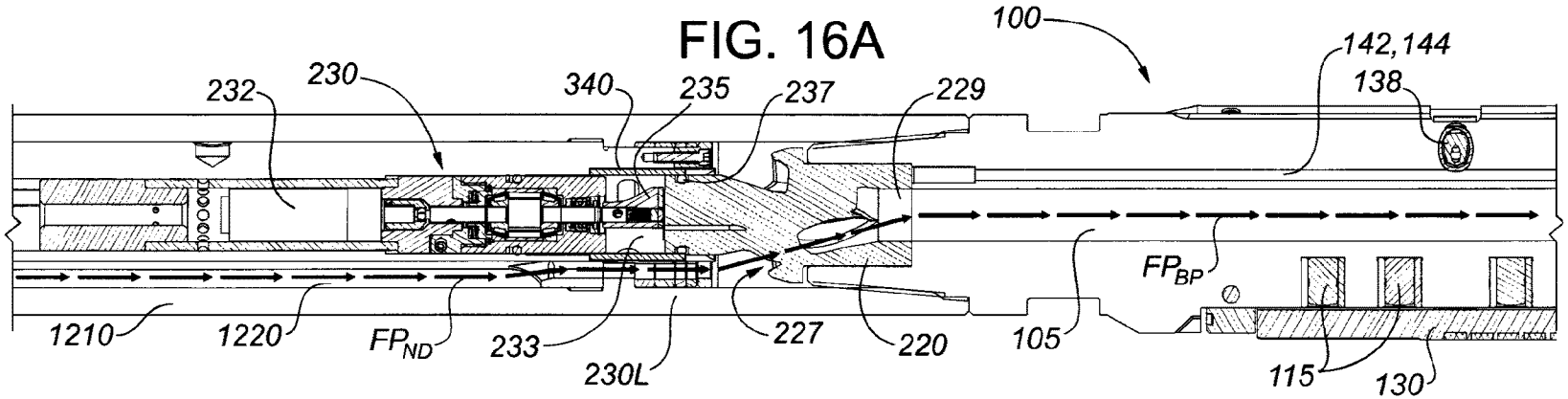
FIG. 16A is a longitudinal section through an alternative RSS tool embodiment in which the secondary valve is provided as a sleeve valve axially movable within the valve section annulus, showing the sleeve valve in the closed position preventing fluid flow from the valve section annulus into the primary valve, such that all of the fluid flow through the valve section annulus bypasses the primary valve and flows into the steering head bore via the bypass channels of the fluid manifold.
Figure 16B:
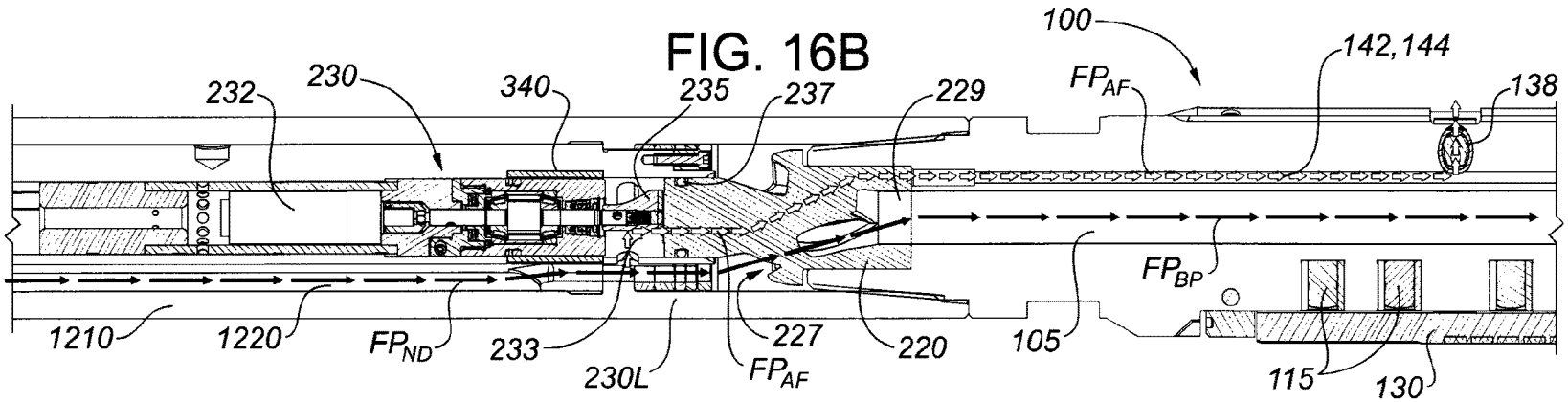
FIG. 16B is a longitudinal section through the alternative embodiment in FIG. 16A, but shown with the sleeve valve in the open position such that a portion of the fluid flowing through the valve section annulus is diverted into the primary valve and into the primary fluid supply channels of the steering head, via the fluid manifold, to actuate the steering head pistons, while an undiverted portion of the fluid flowing through the valve section annulus flows into the steering head bore via the bypass channels of the fluid manifold.

FIGS. 16A and 16B are longitudinal sections through an alternative RSS tool embodiment in accordance with the present disclosure, in which the secondary valve is provided in the form of a sleeve valve 340 that is axially movable to prevent fluid flow from valve section annulus 1220 into fluid chamber 233 in primary valve 230 (as in FIG. 16A), or to allow fluid flow from valve section annulus 1220 into fluid chamber 233 (as in FIG. 16B). Sleeve valve 340 may be actuated by any functionally suitable means, such as but not limited to electrical actuation means and hydraulic actuation means.

It will be readily appreciated by persons skilled in the art that various modifications to embodiments in accordance with the present disclosure may be devised without departing from the scope of the present teachings, including modifications that use equivalent structures or materials hereafter conceived or developed.

It is especially to be understood that the scope of the present disclosure is not intended to be limited to described or illustrated embodiments, and that the substitution of a variant of any claimed or illustrated element or feature, without any substantial resultant change in functionality, will not constitute a departure from the scope of the disclosure.

In this patent document, any form of the word "comprise" is to be understood in its non-limiting sense to mean that any element or feature following such word is included, but elements or features not specifically mentioned are not excluded. A reference to an element or feature by the indefinite article "a" does not exclude the possibility that more than one such element or feature is present, unless the context clearly requires that there be one and only one such element or feature.

Any use herein of any form of the terms "connect", "engage", "couple", "attach", or any other term describing an interaction between elements is not meant to limit the interaction to direct interaction between the subject elements, and may also include indirect interaction between the subject elements such as through secondary or intermediary structure.

For purposes of the present disclosure, relative terms such as "up", "upper", "above", "top", "down", "lower", "below", and "bottom", with reference to components of drill strings and downhole components or assemblies, are to be understood in the sense that "up" with reference to a drill string or a wellbore is toward the ground surface and "down" is toward the drill bit or the bottom of the wellbore, notwithstanding that portions of a drill string or wellbore might in fact have a horizontal or other non-vertical orientation relative to the ground surface.

Relational and conformational terms such as (but not limited to) "parallel", "radial", "axial", "coaxial", and "cylindrical" are not intended to denote or require absolute mathematical or geometrical precision. Accordingly, such terms are to be understood as denoting or requiring substantial precision only (e.g., "substantially parallel" or "generally cylindrical") unless the context clearly requires otherwise. In particular, it is to be understood that any reference herein to an element as being "generally cylindrical" is intended to mean that the element in question may have inner and outer diameters that vary along the length of the element.

Wherever used in this document, the terms "typical" and "typically" are to be understood and interpreted in the sense of being representative of common usage or practice, and are not intended to be understood or interpreted as implying essentiality or invariability.

LIST OF ILLUSTRATED COMPONENTS AND FEATURES

WB Wellbore
$WB_A$ Wellbore annulus
1000 Rotary Steerable System (RSS)
1100 Steering section
1200 Hydraulics (valve) section
1210 Valve section housing
1220 Valve section annulus
100 Steering head
100L Lower end of steering head
100U Upper end of steering head
105 Steering head bore
107 Primary fluid exhaust channel
110 Primary piston chamber
115 Primary piston
120 Secondary piston chamber
125 Secondary piston
130 Pivoting clamshell steering member
132 Steering member retraction tab (tailpiece)
135 Steering member pivot pin
138 Secondary fluid exhaust nozzle
142 Primary fluid supply channel
144 Secondary fluid supply channel
146 Tailpiece retraction pocket
175 Drill bit
180 Alternative location of secondary fluid exhaust nozzle
210 Seal groove on 222
215 Seal element in 210
220 Fluid manifold
220U Upper end of 220
220L Lower end of 220
221 Manifold fluid inlet ports
222 Upper section of 220
223 Lower section of 220
223A Cylindrical surface of 223
224 Manifold fluid passages
225 Manifold fluid outlet ports
226U Flow sleeve connectors
227 Manifold fluid bypass channels
228 Seal elements on 226
229 Manifold fluid bypass outlet
230 Primary (main) valve
230L Lower end of 230
232 Motor/actuator
233 Fluid chamber in 230
235 Primary valve flow restrictor
237 Manifold receiver on 230
240 Secondary valve (solenoid valve embodiment)
340 Secondary valve (sleeve valve embodiment)
$X_{SH}$ Steering head axis
X1 Primary piston axis
X2 Secondary piston axis
$F_R$ Reaction force vector
R Rotational direction arrows
$FP_{ND}$ Flow path—Non-diverted flow in 1220
$FP_{BP}$ Flow path—Bypass flow through 105
$FP_{AF}$ Flow path—Actuating fluid flow to 110 and 120

What is claimed is:

1. A steering tool for drilling deviated wellbores, said steering tool having a generally cylindrical tool housing and a longitudinal tool axis, and further comprising:

(a) a steering head having an upper end coaxially and co-rotatingly mountable to the tool housing, a lower end configured for connecting to a drill bit, and a steering head bore extending between said upper and lower ends of the steering head, and further comprising, at each of one or more axially-spaced locations, a bank of two or more, pistons circumferentially arrayed at a uniform angular spacing, wherein:

(a1) when two or more banks of pistons are provided, all of the banks of pistons have the same number of pistons, and the circumferential positions of the pistons relative to the steering head are the same in all of the banks of pistons;

(a2) each piston has a piston axis and is reciprocatingly movable within an associated piston chamber formed in the steering head, such that each piston is outwardly extendable to exert a force against a wellbore being drilled by the drill bit; and (a3) the steering head defines a plurality of fluid supply channels equal in number to the number of pistons in each bank of pistons, wherein each fluid supply channel is in fluid communication with the one or more piston chambers at a selected one of the circumferential positions, and extends to the upper end of the steering head for conveying fluid for actuating the pistons at the selected circumferential position;

(b) a fluid manifold having an upper end and a lower end, with the lower end of the fluid manifold being coaxially and co-rotatingly mountable to the upper end of the steering head, said fluid manifold defining:

(b1) a plurality of manifold fluid passages equal in number to the number of pistons in each bank of pistons, with each manifold fluid passage extending between a manifold fluid inlet port on the upper end of the fluid manifold and a manifold fluid outlet port on the lower end of the fluid manifold, with each manifold fluid outlet being in fluid communication with a selected one of the plurality of fluid supply channels of the steering head; and (b2) one or more fluid bypass channels extending between an upper region of the fluid manifold and the lower end of the fluid manifold; and (c) a valve section disposed within the tool housing, said valve section defining a valve section annulus between the valve section and the tool housing, and comprising:

(c1) a rotationally geostationary primary valve defining a fluid chamber proximal to a lower end of the primary valve, with said lower end of the primary valve being engageable with the upper end of the fluid manifold such that the fluid chamber will be in fluid communication with the manifold fluid inlet ports; and (c2) a secondary valve disposed within the tool housing and configured to divert a portion of a fluid flowing through the valve section annulus and to deliver the diverted fluid to the primary valve;

wherein the primary valve comprises co-rotating flow restriction means configured to restrict the number of manifold fluid inlets in fluid communication with the fluid chamber at any given time as the fluid manifold and the steering head rotate relative to the primary valve, and wherein a non-diverted portion of the fluid flowing in the valve section annulus can flow into the steering head bore via the one or more fluid manifold bypass channels.

2. The steering tool as in claim 1 wherein the secondary valve comprises a solenoid valve disposed above the primary valve.

3. The steering tool as in claim 1 wherein the secondary valve comprises a sleeve valve disposed and axially movable within the valve section annulus proximal to the fluid chamber of the primary valve.

4. The steering tool as in claim 1 wherein the flow restriction means allows only one manifold fluid inlet to be in fluid communication with the fluid chamber at any given time.

5. The steering tool as in claim 1 wherein the fluid manifold is fabricated by means of an additive manufacturing process.

6. A steering tool for drilling deviated wellbores, said steering tool having a generally cylindrical tool housing and a longitudinal tool axis, and further comprising:

(a) a steering head having an upper end coaxially and co-rotatingly mountable to the tool housing, a lower end configured for connecting to a drill bit, and a steering head bore extending between said upper and lower ends of the steering head, and further comprising:

(a1) two or more steering members arrayed around a circumference of the steering head, with each steering member having a longitudinal side edge pivotably mounted to an outer surface of the steering head;

(a2) at each of one or more axially-spaced locations, a bank of two or more primary pistons circumferentially arrayed at a uniform angular spacing, wherein: when two or more banks of primary pistons are provided, all of the banks of primary pistons have the same number of primary pistons;

each primary piston has a primary piston axis and is reciprocatingly movable within an associated primary piston chamber formed in the steering head, such that each primary piston is outwardly extendable to deflect an associated one of the steering members and thereby to exert a force against a wellbore being drilled by the drill bit; and the steering section defines a plurality of primary fluid supply channels equal in number to the number of primary pistons in each bank of primary pistons, wherein each primary fluid supply channel is in fluid communication with the one or more primary piston chambers at a selected one of the circumferential positions, and extends to the upper end of the steering head for conveying fluid for actuating the primary pistons at the selected circumferential position; and (a3) one or more banks of secondary pistons, with the secondary pistons in each bank of secondary pistons being equal in number to the number of steering members, and with each secondary piston having a secondary piston axis and being reciprocatingly movable within an associated secondary piston chamber formed in the steering head, such that each secondary piston is outwardly extendable to outwardly deflect a retraction tab on an associated steering member and thereby to urge the associated steering member toward a retracted position adjacent to the steering head, and wherein the steering head defines a plurality of secondary fluid supply channels equal in number to the number of secondary pistons, wherein each secondary fluid supply channel is in fluid communication with a selected one of the secondary piston chambers and extends to the upper end of the steering head for conveying fluid for actuating the selected secondary piston;

(b) a fluid manifold having an upper end and a lower end, with the lower end of the fluid manifold being coaxially and co-rotatingly mountable to the upper end of the steering head, said fluid manifold defining:

(b1) a plurality of primary manifold fluid passages equal in number to the number of steering members, with each primary fluid passage extending between a primary manifold fluid inlet port on the upper end of the fluid manifold and a primary manifold fluid outlet port on the lower end of the fluid manifold, with each primary manifold fluid outlet being in fluid communication with a selected one of the primary fluid supply channels of the steering head;

(b2) a plurality of secondary manifold fluid passages equal in number to the number of steering members, with each secondary fluid passage extending between a secondary manifold fluid inlet port on the upper end of the fluid manifold and a secondary manifold fluid outlet port on the lower end of the fluid manifold, with each secondary manifold fluid outlet being in fluid communication with a selected one of the secondary fluid supply channels of the steering head; and (b3) one or more fluid bypass channels extending between an upper region of the fluid manifold and the lower end of the fluid manifold;

(c) a valve section disposed within the tool housing, said valve section defining a valve section annulus between the valve section and the tool housing, and comprising:

(c1) a rotationally geostationary primary valve defining a fluid chamber proximal to a lower end of the primary valve, with said lower end of the primary valve being engageable with the upper end of the fluid manifold such that the fluid chamber will be in fluid communication with the manifold fluid inlet ports; and (c2) a secondary valve disposed within the tool housing and configured to divert a portion of a fluid flow through the valve section annulus and to deliver the diverted fluid flow to the primary valve;

wherein the primary valve comprises co-rotating flow restriction means configured to restrict the number of manifold fluid inlets in fluid communication with the fluid chamber at any given time as the fluid manifold and the steering head rotate relative to the primary valve, and wherein a non-diverted portion of the fluid flow in the valve section annulus can flow into the steering head bore via the one or more fluid manifold bypass channels.

7. The steering tool as in claim 6 wherein the number of manifold fluid inlet ports is double the number of steering members, and wherein each primary and secondary manifold fluid passage is in fluid communication with a separate one of the manifold fluid inlet ports.

8. The steering tool as in claim 6 wherein the number of manifold fluid inlet ports equals the number of steering members, and wherein each manifold fluid inlet port is in fluid communication with one primary manifold fluid passage and one secondary manifold fluid passage.

9. The steering tool as in claim 6 wherein the secondary valve comprises a solenoid valve disposed above the primary valve.

10. The steering tool as in claim 6 wherein the secondary valve comprises a sleeve valve disposed and axially movable within the valve section annulus proximal to the fluid chamber of the primary valve.

11. The steering tool as in claim 8 steering tool wherein the flow restriction means allows only one manifold fluid inlet to be in fluid communication with the fluid chamber at any given time.

12. The steering tool as in claim 6 wherein the fluid manifold is fabricated by means of an additive manufacturing process.

* * * * *